US007302815B2

(12) United States Patent
Kim et al.

(10) Patent No.: US 7,302,815 B2
(45) Date of Patent: Dec. 4, 2007

(54) WASHING MACHINE AND DRYER HAVING BEING IMPROVED DUCT STRUCTURE THEREOF

(75) Inventors: Jong Seok Kim, Changwon-shi (KR); Yang Hwan No, Changwon-shi (KR); Han Ki Cho, Changwon-shi (KR); Yeon Su Jung, Changwon-shi (KR); Jung Hoon Kang, Changwon-shi (KR); Myung Sik Park, Changwon-shi (KR); Young Hoon Ha, Masan-shi (KR)

(73) Assignee: LG Electronics Inc., Seoul (KR)

( * ) Notice: Subject to any disclaimer, the term of this patent is extended or adjusted under 35 U.S.C. 154(b) by 658 days.

(21) Appl. No.: 10/471,674

(22) PCT Filed: Jan. 11, 2003

(86) PCT No.: PCT/KR03/00053

§ 371 (c)(1),
(2), (4) Date: Sep. 11, 2003

(87) PCT Pub. No.: WO03/057968

PCT Pub. Date: Jul. 17, 2003

(65) Prior Publication Data

US 2004/0103697 A1 Jun. 3, 2004

(30) Foreign Application Priority Data

Jan. 11, 2002 (KR) ..... 10-2002-0001732
Jan. 11, 2002 (KR) ..... 10-2002-0001735
Jan. 17, 2002 (KR) ..... 10-2002-0002689
Jan. 17, 2002 (KR) ..... 10-2002-0002690
Jan. 17, 2002 (KR) ..... 10-2002-0002691

(51) Int. Cl.
*D07F 39/04* (2006.01)

(52) U.S. Cl. ..... 68/18 C; 34/264

(58) Field of Classification Search ..... 68/18 C, 68/15; 34/264
See application file for complete search history.

(56) References Cited

U.S. PATENT DOCUMENTS

| | | | | | |
|---|---|---|---|---|---|
| 2,341,319 | A | * | 2/1944 | Graham et al. | 165/156 |
| 2,873,537 | A | * | 2/1959 | Gray, Jr. et al. | 34/75 |
| 2,940,179 | A | * | 6/1960 | Czech | 34/77 |
| 3,012,333 | A | * | 12/1961 | Leonard | 34/75 |
| 3,029,525 | A | * | 4/1962 | Pinder | 34/75 |
| 3,075,296 | A | * | 1/1963 | Stone | 34/75 |
| 3,121,000 | A | * | 2/1964 | Hubbard | 34/75 |
| 3,866,333 | A | * | 2/1975 | Sarukahanian et al. | 34/75 |
| 3,875,679 | A | * | 4/1975 | Condit | 34/75 |
| 4,154,003 | A | * | 5/1979 | Muller | 34/469 |
| 5,038,586 | A | * | 8/1991 | Nukaga et al. | 68/12.01 |
| 5,146,693 | A | * | 9/1992 | Dottor et al. | 34/77 |
| 5,588,313 | A | | 12/1996 | Hildebrand | |
| 5,983,520 | A | * | 11/1999 | Kim et al. | 34/261 |
| 6,042,636 | A | * | 3/2000 | Aishima et al. | 95/92 |

FOREIGN PATENT DOCUMENTS

| | | | |
|---|---|---|---|
| DE | 30 09 954 | * | 9/1981 |
| DE | 4436673 | | 4/1996 |
| EP | 0499029 | | 8/1992 |
| EP | 0499029 A1 | | 8/1992 |
| FR | 2 646 501 | * | 11/1990 |
| GB | 2 172 977 | * | 10/1986 |
| GB | 2 215 826 | * | 9/1989 |
| GB | 2 223 240 | * | 4/1990 |
| JP | 55-78996 | | 6/1980 |
| JP | 4-25683 | | 1/1992 |
| JP | 04-231996 | | 8/1992 |
| JP | 4-347198 | * | 12/1992 |
| JP | 8-215471 | | 8/1996 |
| JP | 10235087 | | 9/1998 |
| JP | 11-114292 | | 4/1999 |
| JP | 11-347282 | | 12/1999 |
| JP | 2000-237497 A | | 9/2000 |
| JP | 2001-269495 | | 10/2001 |
| JP | 2001-293278 | | 10/2001 |

OTHER PUBLICATIONS

European Patent Office 0 485 700 Aug. 1991.*
European Patent Office 0 636 732 Jul. 1994.*

European Patent Office 0 548 386 Dec. 1991.*
International Search Report; Feb. 27, 2003; Austrian Patent Office; 2 pages.

* cited by examiner

*Primary Examiner*—Frankie L. Stinson
(74) *Attorney, Agent, or Firm*—McKenna Long & Aldridge LLP

(57) ABSTRACT

Disclosed is a washing machine and dryer having a condensation unit (700). A tub (200) is installed in a cabinet (100), and a drum is rotatably installed within the tub (200). A drying duct (610) has one end connected with an interior of the tub (200), and a condensation duct (710) connects the tub (200) with the drying duct (610). A cooling water supply unit (720) is provided in one side of the condensation duct (710) to supply cooling water supplied from an outside to the interior of the condensation duct (710). A cooling water dropping unit (750) collects the cooling water supplied to an interior of the condensation duct to drop the collected cooling water to the inner space of the condensation duct. A heater (620) heats air circulating the tub (200), the condensation duct (710), and the drying duct (610), and a circulation fan (800) circulates the air. A drain pump (500) discharges washing water in the tub (200) outside the cabinet (100). To dry laundry in the drum (300), the drum (300) rotates, the heater (620) and the circulation fan (800) operate, and cooling water is fed into the condensation duct (710) through the cooling water supply unit (720). Moist absorbing moisture while drying the laundry in the drum (300) exchanges heat with the cooling water dropped by a cooling water dropping unit (750) while being via the condensation duct (710), and is condensed to remove moisture, so that dry performance of the washing machine is enhanced.

65 Claims, 19 Drawing Sheets

WASHING MACHINE AND DRYER HAVING BEING IMPROVED DUCT STRUCTURE THEREOF

TECHNICAL FIELD

The present invention relates to a washing machine and dryer having the dry function, and more particularly, to a washing machine and dryer having an improved condensation duct in which moisture contained in moist air dried in the drum is removed.

BACKGROUND ART

Generally, a washing machine is an apparatus which performs washing, rinsing and dewatering so as to separate dirt from clothes by the interaction of detergent and water, and is classified into agitator type, pulsator type and drum type washing machines.

The agitator type washing machine washes laundry by rotating a washing rod overtopping at the center of the washing tub in left and right directions. This agitator type washing machine has a superior washing power, but also has disadvantages such as large noise and vibration, and damage of laundry. The agitator type washing machine is appropriate for a large-sized washing machine.

The pulsator type washing machine performs the washing by water current and frictional force generated by rotating a circular plate-shaped pulsator formed at the lower side of the washing machine. This pulsator type washing machine has maximum advantages in that the washing time is short, a large capacitive structure is possible, and other advantages such as relatively low noise and vibration and low costs, but it also has great disadvantages in that tangling phenomenon of laundry is caused and damage of laundry is relatively high.

In the drum type washing machine, water, detergent and laundry are loaded into a drum with a plurality of protruded tumbling ribs installed in an inner surface of the drum and the drum is rotated at a low speed. Then, the laundry is washed due to an Impact caused when the laundry is lifted by the tumbling ribs and then drops. The drum type washing machine has an advantage in that the laundry is not damaged. In addition, a small amount of water is consumed and the laundry is not tangled with each other.

Meanwhile, a dryer is a machine for automatically drying a wet laundry after completing a washing operation. In general, the wet laundry is loaded into a drum installed in an inner side of a cabinet and the drum is rotated. Then, a hot wind is supplied to an inside of the drum to thereby dry the wet laundry.

Recently, a combination dryer and drum washing machine, in which a dryer function as well as a washing function is added to the drum type washing machine, is practically available and its use increases gradually.

FIG. 1 and FIG. 2 are cross sectional view and front sectional view showing inner structures of a general washing machine and dryer. Hereinafter, a detailed structure of the general washing machine and dryer will be described with reference to FIGS. 1 and 2.

Referring to FIGS. 1 and 2, the general washing machine and dryer includes a cabinet 10, a tub 20, a drum 30, a motor 40, a drain pump 50, a condensation unit 70, a drying unit 60, and a circulation fan 80.

The cabinet 10 forms an outer shell of the washing machine and dryer. A door 11 is provided at a front side of the cabinet 10. In case of the washing machine, a detergent box 14 is provided at one side of the interior of the cabinet 10. A washing water feed tube 150 led-in from an outside of the cabinet 10 is connected to the detergent box 14.

The tub 20 is cylinder-shaped, and is provided within the cabinet 10. This tub 20 is supported by a spring 13 and a damper 12.

The drum 30 is cylinder-shaped and is rotatably provided within the tub 20. A plurality of penetration holes are formed in the outer circumferential surface of the tube 20 constituted as above, and washing water supplied into the tub 20 through the penetration holes flows in or out the drum 30. A plurality of tumbling ribs 31 are provided on the inner surface of the drum 30.

The motor 40 is provided within the cabinet 40, and is connected with the drum 30 by a belt or the like to rotate the drum 30.

The drain pump 50 is connected with a lower side of the tub 20, and it pumps and discharges the water staying in the lower side of the tub 20 outside the cabinet 10 after washing, rinsing and dewatering. For this purpose, a drain hose 51 is installed to connect an outside of the cabinet 10 with the drain pump 50.

The drying unit 60 includes a drying duct 61 and a heater 62. The drying duct 61 is provided at an upper outer side of the tub 20, and its one end is connected with an inside of the tub 20. The heater 62 is installed in the drying duct 61 so as to heat air circulating the inside of the drying duct 61.

The condensation unit 70 includes a condensation duct 71, a cooling means for cooling and condensing the air flowing through the condensation duct 71.

The condensation duct 71 is installed such that one end thereof is connected to a lower side of the tub 20 and the other end is connected with the drying duct 61. As shown in FIG. 1, the condensation duct 71 is installed in an oblique direction so as to increase the contact area with the cooling water and the outer air. Also, the condensation duct 71 is formed in a rectangular type of which cross section is flat, so as to reduce the installation space.

In the meanwhile, the cooling means, as shown in FIGS. 1 and 2, is a water-cooling type, and includes a cooling water supply unit 75. The cooling water supply unit 75 is installed at one side of the condensation duct 71, and functions to feed the cooling water fed from an outside into the inside of the condensation duct 71.

The circulation fan 80 is installed within the drying duct 61, and it circulates the air within the drum 30 through the condensation duct 71 and the drying duct 61.

Meanwhile, in order to prevent the inverse current of the washing water due to an external factor during the discharge of the washing water in the washing machine having the aforementioned constitution, there is provided a siphon hose 90. The siphon hose 90 is installed to connect the detergent box 14 with one end of the drain hose 51. If the siphon hose is installed as above, the washing water inversely flowing through the drain hose 51 is introduced toward the siphon hose 90, thereby reducing the influence of the inverse current. In case the inverse current amount of he washing water is somewhat large, the washing water introduced toward the siphon hose 90 is via the detergent box 14, flows down along the inner sidewall of the tub 20, and is again discharged to the outside.

The general drum washing machine constituted as above performs washing and drying operations as follows.

First, laundry is loaded into the drum 30. A proper amount of detergent is supplied into the detergent box 14 and washing water is also supplied through the water feed tube 15, so that washing water dissolving the detergent in the detergent box 14 is introduced into the tub 20 through the water feed hose 16. If the washing water is supplied up to a level within the tub 20, the drum 30 rotates to start the washing. At this time, the washing is performed while the laundry is lifted upwardly by the tumbling rib 31 along with the rotation of the drum 30, and is then dropped downwardly. In the meanwhile, whenever the washing, rinsing and dewatering steps are completed, the drain pump 50 operates to discharge the washing water within the tub 20 outside the cabinet 10 through the drain hose 51.

If the aforementioned washing step is completed, the heater 65 and the circulation fan 80 operate and the drum 30 rotates to perform the drying step. At this time, cooling water flows in the condensation duct 71 through the cooling water supply unit 75 of the condensation unit 70. If the drying step starts, the air within the drum 30 circulates the condensation duct 71, the drying duct 61, and the drum 30 sequentially. The air heated by the heater 65 vaporizes the moisture contained in the laundry within the drum 30, and the air containing the moisture is introduced into the condensation duct 71. The moist air introduced into the condensation duct 71 exchanges heat with the cooling water flowing down along the inner surface of the condensation duct 71, so that the moisture is condensed and removed. The air dried by the removal of the moisture in the condensation duct 71 is heated by the heater 65 in the drying duct 61, and then supplied to the drum 30. The aforementioned steps are repeated to thereby dry the laundry.

In the conventional drum washing machine and dryer constituted as above, in order to increase the contact area of the air passing through the condensation duct 71 with the cooling water, the condensation duct 71 is installed in an oblique direction. To this end, a large installation space for the condensation duct 71 and the drying duct 61 is necessary, and assembly process thereof is difficult.

In addition, in the drum washing machine having the inverse current preventing structure of the washing water, in case the amount of the inverse current washing water is excessive, the washing water introduced into the siphon hose 90 passes through the detergent box 14 and then poured to the inside of the drum 30. To this end, there is caused a problem in that the washing-completed laundry is again contaminated.

DISCLOSURE OF THE INVENTION

Accordingly, the present invention is directed to a washing machine and dryer that substantially obviates one or more of the problems due to limitations and disadvantages of the related art.

An object of the present invention is to provide a washing machine and dryer in which the structure of a condensation unit is improved, i.e., the length of the condensation duct decreases, thereby increasing practical use of space and making the washing machine and dryer compact.

Another object of the present invention is to provide a washing machine and dryer in which the structure of a condensation unit is improved to enhance the condensation efficiency, thereby improving the dry efficiency of the washing machine and dryer.

A further another object of the present invention is to provide a washing machine and dryer in which the structure of a condensation unit is improved, i.e., the condensation duct is made in a linear type, thereby allowing easy installation and easy assembling.

Still another object of the present invention is to provide a washing machine and dryer in which the inverse current preventing structure of washing water is improved to prevent contaminated washing water inversely flowing during the drain cycle from being again introduced into the drum.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, To further achieve these and other advantages and in accordance with the purpose of the present invention, a washing machine and dryer includes a cabinet, a tub, a drying unit, a condensation unit, a circulation fan and a drain pump.

The tub is provided in the cabinet, and a drum is rotatably installed in the tub.

The drying unit includes a drying duct of which one end is connected with an interior of the tub, and a heater provided in the drying duct.

The condensation unit includes a condensation duct, a cooling water supply unit, and a cooling water dropping unit.

The condensation duct of which one end is connected with the drying duct and the other end is connected with the tub is installed such that air in the tub flows.

The cooling water supply unit is provided in a side of the condensation duct, and supplies cooling water supplied from an outside to the interior of the condensation duct. The cooling water supply unit includes: a water feed tube through which the cooling water supplied from an outside flows; and a water feed nozzle to which the water feed tube is connected, and for supplying the cooling water to the inside of the condensation duct. Here, the water feed tube is rotatably connected to the water feed nozzle with maintaining a sealing state with respect to the water feed nozzle, or is connected to the water feed nozzle so as to have a predetermined back and forth separation with maintaining a sealing state with respect to the water feed nozzle.

The cooling water dropping unit collects the cooling water supplied to an interior space of the condensation duct to drop the collected cooling water to the inner space of the condensation duct.

The circulation fan circulating the air in the tub so as to be via the condensation duct and the drying duct. The drain pump discharges washing water in the tub outside the cabinet.

Here, the heater is installed in the drying duct, and the circulation fan is installed at a connecting portion of the drying duct and the condensation duct.

Also, the condensation duct includes: a middle part extending in the upward and downward direction; a lower part extending from a lower end of the middle part and connected with the tub; and an upper part extending from an upper end of the middle part and connected with the drying duct.

The middle part is shaped in a cylinder. The lower part is curved in a direction into which air is introduced so as to lower resistance of the air introduced from the tub. The upper part is formed in a wide step shape at one side of the middle part.

In a washing machine and dryer according to a first embodiment of the present invention, the cooling water dropping unit includes a dropping plate projected from one side of inner surface of the condensation duct so as to drop the cooling water flowing down along the inner surface of the condensation duct into the inner space of the condensation duct.

Here, the dropping plate is integrally formed in the inner surface of the condensation duct, or is formed by a molding process such that the condensation duct is projected inwardly. The dropping plate formed as above is projected to be inclined at an angle of approximately 45 degree toward the downward direction of the inner space of the condensation duct from the inner surface of the condensation duct.

In a washing machine and dryer according to a first embodiment of the present invention, an inverse current preventing plate is further provided. The inverse current preventing plate is projected from the inner surface of the condensation duct at the upper side of the dropping plate so as to prevent the cooling water dropping from the dropping plate from being dispersed toward the upper side by the air flowing through the condensation duct and moved toward the drying duct. The inverse current preventing plate is integrally formed with the condensation duct.

Meanwhile, in case the inverse current preventing plate is formed, the condensation duct has a widened portion at an opposite side to a portion where the inverse current preventing plate projected so as to prevent air passage of the portion where the inverse current preventing plate projected from being narrowed.

In a washing machine and dryer according to a second embodiment of the present invention, the cooling water dropping unit includes a rib projected in the form of a loop along an inner circumferential surface of the condensation duct so as to drop the cooling water flowing down along the inner surface of the condensation duct into the inner space of the condensation duct.

Here, the rib is formed approximately at a lower side of the condensation duct. The rib is integrally formed with the condensation duct, or is formed by a molding process such that the condensation duct itself is projected inwardly.

Meanwhile, the rib is formed in an elliptic structure to be inclined with respect to the horizontal plane. In this case, the inclination angle of the rib is approximately 45 degrees.

Also, the rib has at least one slit for dropping the cooling water inclinedly flowing down along an upper surface of the rib toward the lower side. At this time, the slit includes a plurality of slits arranged in a circumferential direction of the rib, or is formed approximately at a lower side of the rib installed inclinedly. Also, the slit is formed to cross a part of the rib from an inner circumferential portion to an outer circumferential portion of the rib, or is formed approximately at a middle position from inner circumferential portion to an outer circumferential portion of the rib.

Alternatively, the rib has at least one dropping hole for dropping the cooling water inclinedly flowing down along an upper surface of the rib toward a lower side. In this case, the dropping hole includes a plurality of dropping holes arranged in a circumferential direction of the rib. The dropping hole is formed approximately at a lower side of the rib installed inclinedly.

Also, the rib is formed horizontally in a circular structure. In this case, the rib may include a plurality of slits or dropping holes like that as formed as the elliptic structure.

In a washing machine and dryer according to the present invention, the cooling water dropping unit includes a distribution means which is supplied with the cooling water from the cooling water supply unit to drop the supplied cooling water to the inside of or an inner circumferential surface of the condensation duct.

In a washing machine and dryer according to a third embodiment of the present invention, the distribution means includes: a connection tube connected with the cooling water supply unit, for being supplied with the cooling water; and a distribution loop connected with the connection tube, for uniformly dropping the cooling water to the inside of or the inner circumferential surface of the condensation duct.

Here, the distribution loop has a cross section shaped in the letter of "U". Also, the distribution loop has a widened portion connected with the connection tube.

Preferably, a plurality of injection holes are formed at a lower side of the distribution loop, for injecting the cooling water. The plurality of injection holes are formed along a lower center portion of a cross section of the distribution loop such that the cooling water drops to the inner space of the condensation duct, or are formed along a portion of a lower side of the cross section of the distribution loop.

Alternatively, the plurality of injection holes are formed inclined from an upper side to a lower side thereof. In this case, the plurality of injection holes are inclined toward an outer circumferential surface of the distribution loop such that the cooling water within the distribution loop is injected toward the inner circumferential surface of the condensation duct, or are inclined toward an inner circumferential surface of the distribution loop such that the cooling water within the distribution loop is injected toward an inner space of the condensation duct.

In the washing machine and dryer according to the third embodiment of the present invention, the distribution means further include a storage tank for storing a predetermined amount of the cooling water at a portion where the connection tube and the distribution loop are connected with each other.

In a washing machine and dryer according to a fourth embodiment of the present invention, the distribution means is a guide passage formed in a spiral structure at an inner surface of the condensation duct so as to guide the cooling water supplied from the cooling water supply unit and uniformly distribute and flow the guided cooling water on the inner circumferential surface of the condensation duct.

Here, the guide passage is formed approximately at an upper side of the condensation duct. In a washing machine and dryer according to a fourth embodiment of the present invention, the guide passage is comprised of a spiral groove which is formed to be convex from the inner surface side to the outer surface side, or is comprised of a spiral guide tube which is installed such that the cooling water supplied from the cooling water supply unit flows into the inside of the guide tube.

Meanwhile, in case the guide means is comprised of the guide tube, a plurality of distribution holes may be formed at a lower side of the guide tube, for injecting the cooling water. Here, the plurality of distribution holes are formed along a center portion of the lower side of a cross section of the guide tube such that the cooling water drops to the inner space of the condensation duct, or are formed along one side of the lower side of the cross section of the guide tube. Alternatively, the plurality of distribution holes are formed inclined from an upper side to a lower side thereof. For instance, the plurality of distribution holes are inclined toward the inner circumferential surface of the condensation duct such that the cooling water within the guide tube is injected toward the inner circumferential surface of the condensation duct, or are inclined toward an inner center of the condensation duct such that the cooling water within the guide tube is injected toward the inner space of the condensation duct.

In a fifth embodiment of the present invention, a washing machine and dryer further includes a siphon hose connecting a drain hose connected with the drain pump with the cooling water supply unit and for supplying the cooling water flowing inversely through the drain hose to the cooling water supply unit. Also, the cooling water supply unit includes: a water feed tube through which the cooling water supplied from an outside flows; and a water feed nozzle to which the water feed tube and a siphon hose are connected, and for supplying the cooling water to the inside of the condensation duct.

In the washing machine and dryer according to the fifth embodiment of the present invention, the water feed nozzle includes: a cylindrical nozzle body of which one end is opened; a first connection hole formed at one side of the nozzle body and to which the water feed tube is connected; and a second connection hole formed at the other side of the nozzle body and to which the siphon hose is connected. Here, the nozzle body further includes an air hole for maintaining the inside and the outside of the condensation duct at the same pressure. For instance, the air hole is formed at the closed other end of the nozzle body.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Figure 1:
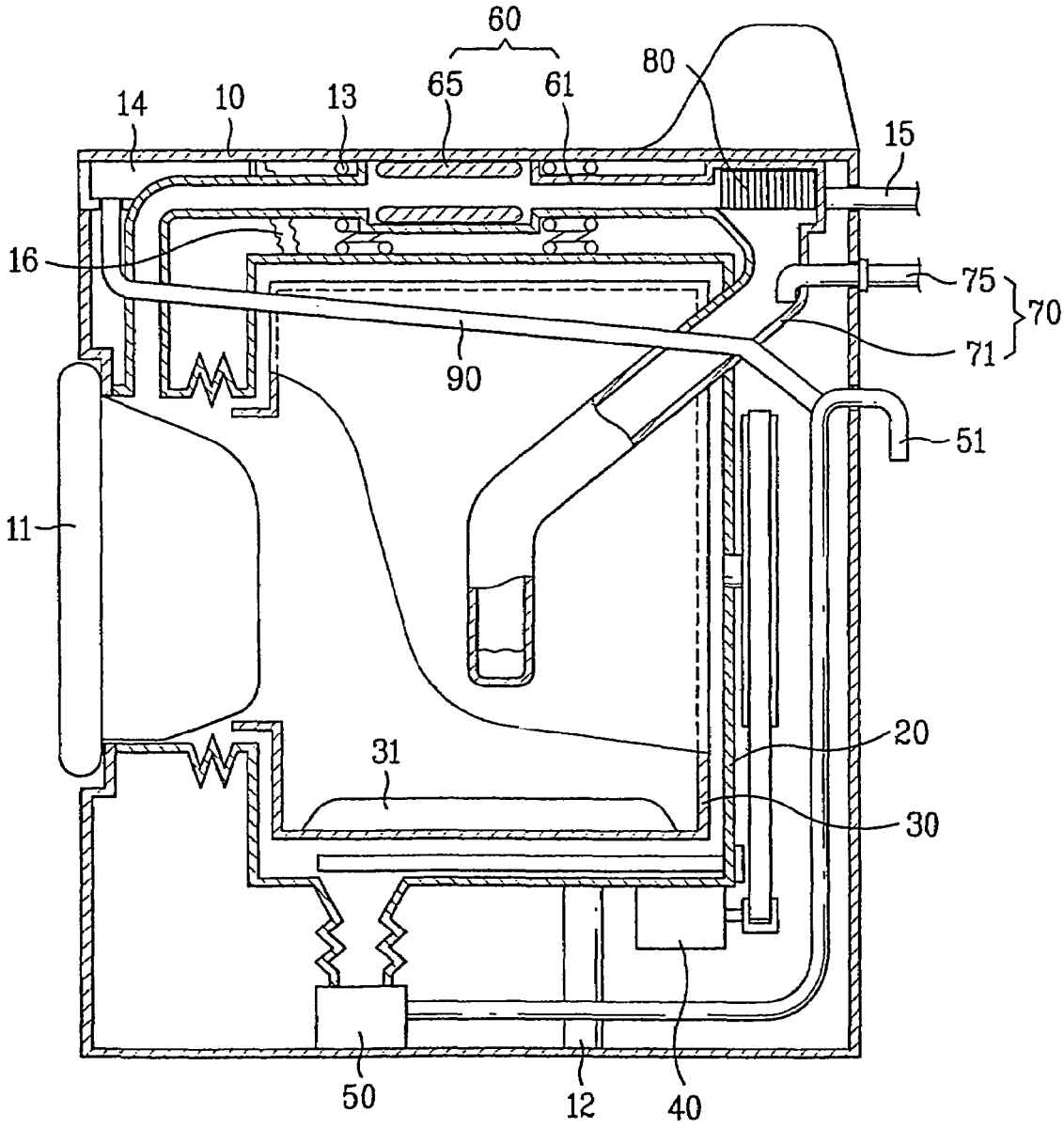
FIG. 1 and FIG. 2 are cross sectional view and front sectional view showing inner structures of a general washing machine and dryer.

Reference will now be made in detail to the preferred embodiments of the present invention, examples of which are illustrated in the accompanying drawings. Wherever possible, the same reference numbers will be used throughout the drawings to refer to the same or like parts, and additive explanation thereof will be omitted.

A washing machine and dryer according to the present invention, includes a cabinet 100, a tub 200, a drum 300, a drying duct 610, a condensation unit 700, a heater 620, a circulation fan 800, a drain pump 500. Hereinafter, detailed structure of the washing machine and dryer will be described with reference to FIGS. 3 and 4.

The cabinet 100 constitutes an outer shell of the washing machine and dryer. A door 110 is provided at one side, i.e., front side of the cabinet 100, and a control panel is provided at an upper side of the door 110. In case the present invention is applied to the washing machine, a detergent box 140 is provided at one side of the interior of the cabinet 100. A washing water feed tube 150 led-in from an outside of the cabinet 100 is connected to the detergent box 140. A water feed hose 160 is installed to connect the detergent box 140 with the tub 200.

The tub 200 is cylinder-shaped, and is provided within the cabinet 100. This tub 200 is supported by a spring 130 and a damper 120, each of which both ends are respectively connected with the inner surface of the cabinet 100 and the outer surface of the tub 200, and a vibration of the tub 200 is attenuated by the spring 130 and the damper 120.

In the meanwhile, the tub 200 is installed horizontally with the bottom surface of the cabinet 100, but it may be installed to be slightly inclined such that a side adjacent to the door 110 is leveled higher than an opposite side to the adjacent side. In case the tub 200 installed as above is applied to a washing machine, it is connected with the detergent box 140 by the water feed tube 150.

The drum 300 is cylinder-shaped and is rotatably provided within the tub 200. A plurality of penetration holes are formed in the outer circumferential surface of the tube constituted as above, and washing water supplied into the tub 200 through the penetration holes or water dropped from wet laundry received in the drum 300 freely flows in or out between the tub 200 and the drum 300. A plurality of tumbling ribs 3 10 are projected from the inner surface of the drum 300. These projected tumbling ribs 310 lift laundry during the rotation of the drum 300 and then allow the lifted laundry to fall freely.

The motor 400 is provided within the cabinet 400, and is connected with the drum 300 by a belt or the like to rotate the drum 300. Of course, if necessary, the motor 400 may be connected with various elements needing a power for the movement to transfer its rotational force.

The drain pump 500 is connected with a lower side of the tub 200, and it pumps and discharges the water staying in the lower side of the tub 200 outside the cabinet 100 after washing, rinsing and dewatering. For this purpose, the drain hose 510 is installed to connect an outside of the cabinet 100 with the drain pump 500.

A drying unit 600 includes the drying duct 610 and the heater 620. The drying duct 610 is provided at an outside of the tub 200, for instance, at an upper outside of the tube, and its one end is connected with an inside of the tub 200. The heater 620 is installed in the drying duct 610 so as to heat air circulating the inside of the drying duct 610.

The condensation unit 700 includes a condensation duct 710, a cooling water supply unit 720 and a cooling water dropping unit 750.

Figure 9:
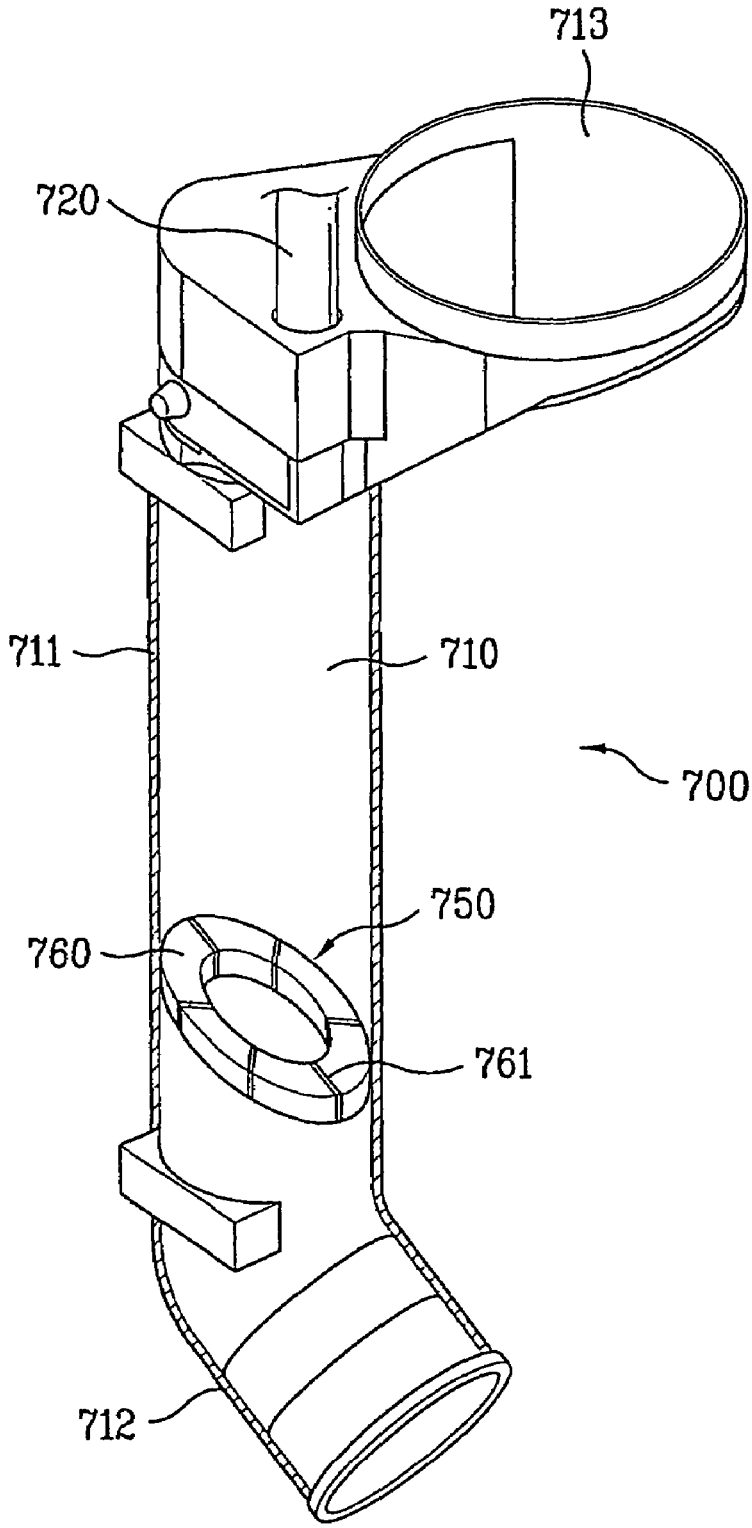
FIG. 9 and FIG. 10 are sectional views showing inner structures of the cooling water dropping unit in a washing machine and dryer according to the second embodiment of the present invention.

The condensation duct 710 of which one end is the drying duct 610 and the other end is connected to the tub 200 is installed such that the air in the tub 200 can flow through the inside of the condensation duct 710. The condensation duct 710 installed as above includes a middle part 711, a lower part 712 and an upper part 713 as shown in FIG. 9.

The middle part 711 is made in a long cylinder shape. The lower part 712 extending from the lower side of the middle part 711 is connected with the tub 200, and is curved in an air inflow direction so as to reduce resistance of the air introduced from the tub 200, as shown in FIGS. 5 to 9. The upper part 713 extending from the upper side of the middle part 711 is connected with the drying duct 610, and is formed in a wide step shape at a side of the upper side of the middle part 711 as shown in FIGS. 5 to 9.

Figure 3:
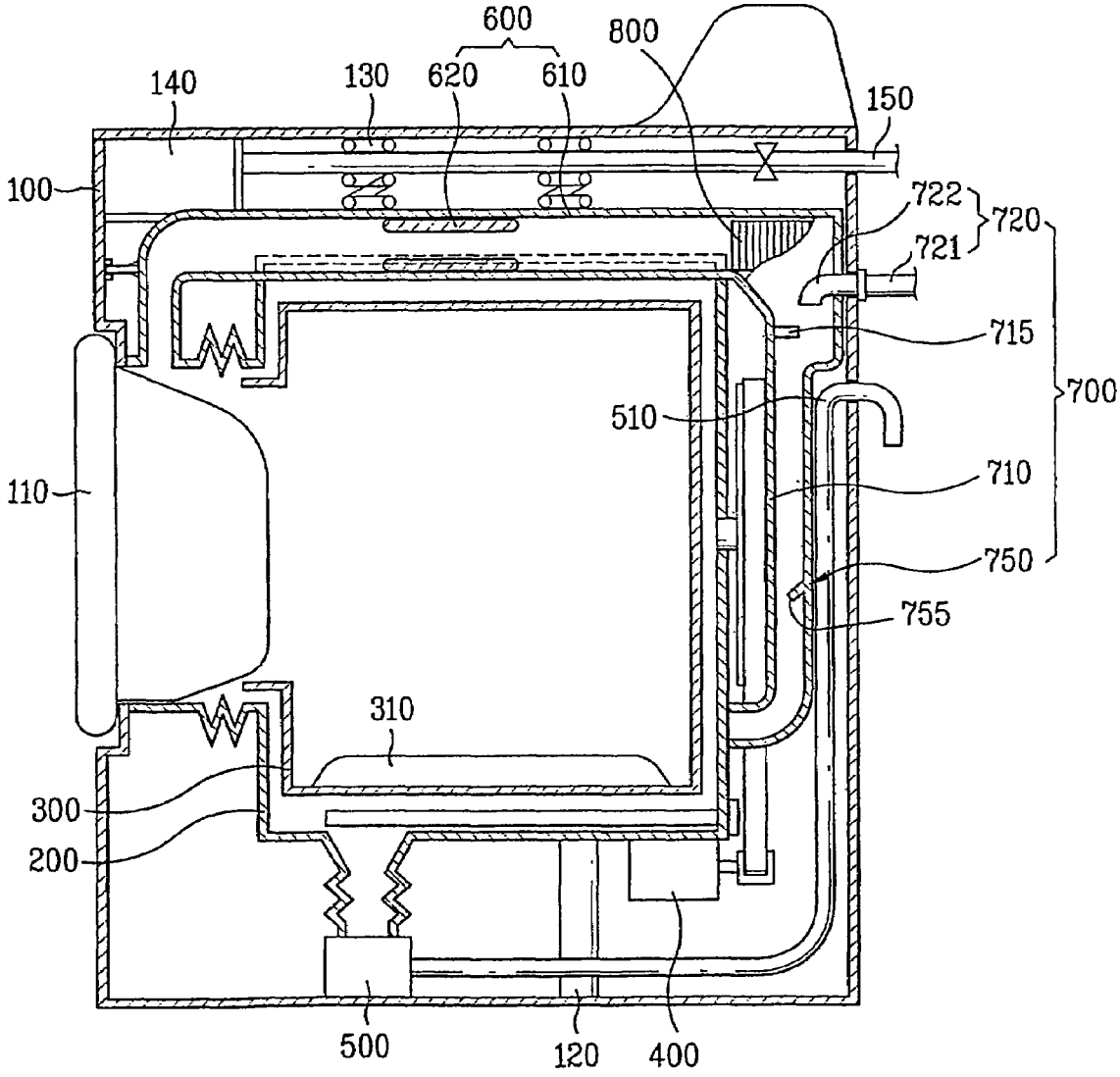
FIG. 3 and FIG. 4 are cross sectional view and front sectional view showing inner structures of a washing machine and dryer according to a first embodiment of the present invention.
Figure 4:
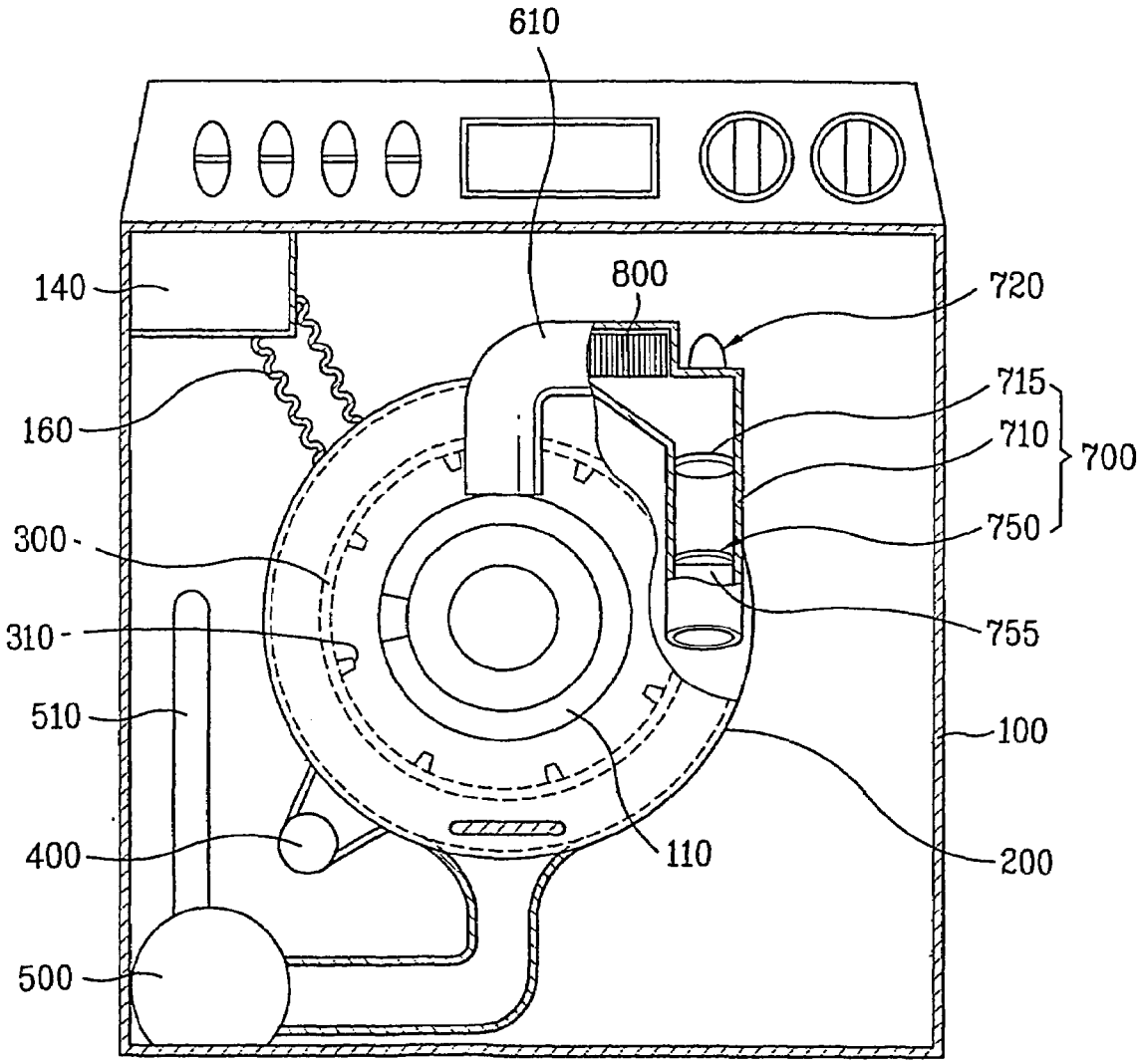

The cooling water supply unit 720 is installed at one side of the condensation duct 710, and functions to feed the cooling water fed from an outside into the inside of the condensation duct 710. This cooling water supply unit 720 includes a water feed tube 721 and a water feed nozzle 722. The water feed tube 721, as shown in FIG. 3, is installed to penetrate the cabinet 100 so as to enable the supply of the cooling water. Cooling water flows through the inside of the water feed tube 721 installed as above. The water feed nozzle 722, as shown in FIGS. 3 and 4, is connected with one end of the water feed tube 721 to supply the cooling water supplied toward the inside of the cabinet 100 through the water feed tube 721 toward the inside of the condensation duct 710.

In the meanwhile, in a washing machine and dryer according to the present invention, the water feed tube 721 is rotatably connected with maintaining a sealing status with respect to the water feed nozzle 722, and is preferably connected to have a predetermined back and forth separation with respect to the water feed nozzle 722. This is to prevent leakage of cooling water and disorder of the apparatus in advance by designing the water feed tube 721 to effectively correspond to the vibration generated by the rotation of the drum 300. The aforementioned connection structure is mainly used when connecting two or more pipes under a vibration condition. Since such a fact is apparent to those skilled in the art, a detailed connection structure is not shown in the present specification and its description is also omitted.

The cooling water dropping unit 750 is provided at an inside of the condensation duct 710, and functions to collect the cooling water fed to the inside of the condensation duct 710 by the cooling water supply unit 720 and drop the collected cooling water into the inner space of the condensation duct 710. The cooling water dropping unit 750 performing such a role can be embodied in various embodiments, and its detailed constitution will be described in detail with describing embodiments of a washing machine and dryer according to the present invention.

In the meanwhile, the circulation fan 800 is installed within the drying duct 610, or at a connection portion of the drying duct 610 and the condensation duct 710 to be described later to circulate the air within the drum 300 such that the air is via the condensation duct 710 and the drying duct 610.

The washing machine and dryer constituted as above can be embodied in various embodiments by providing different condensation units. Hereinafter, embodiments will be described with reference to the accompanying drawings, and the repetition of the above content in the respective embodiments will be omitted.

FIGS. 3 to 6 show a washing machine and dryer according to a first embodiment of the present invention. Referring to these drawings, in the washing machine and dryer of the present invention, the cooling water dropping unit 750 of the condensation unit 700 includes a dropping plate 755 projected on an inner surface of the condensation duct 710.

Figure 5:
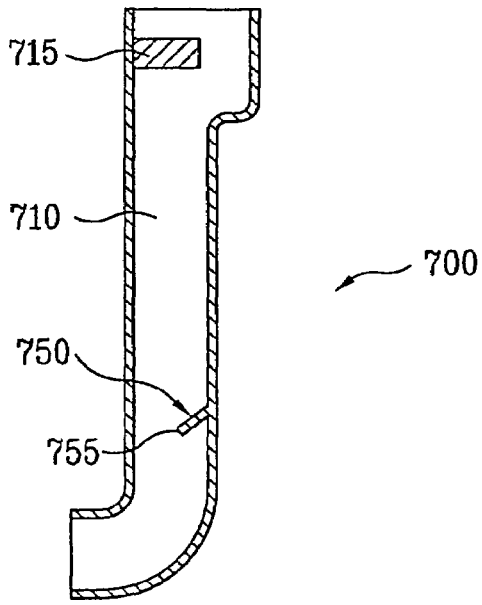
FIG. 5 and FIG. 6 are sectional views showing examples of the cooling water dropping unit in the washing machine and dryer according to the first embodiment of the present invention.
Figure 6:
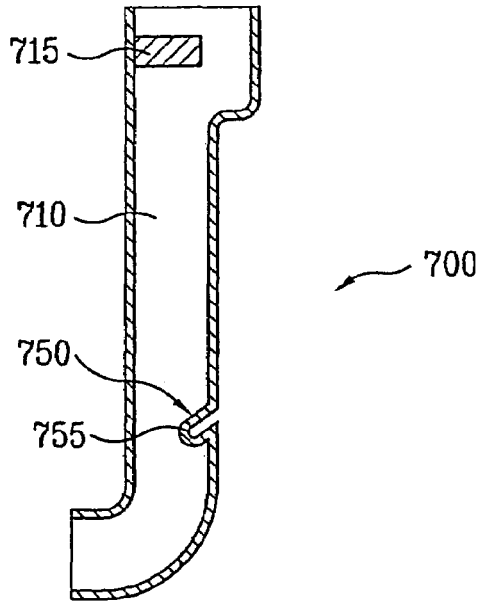
Figure 7:
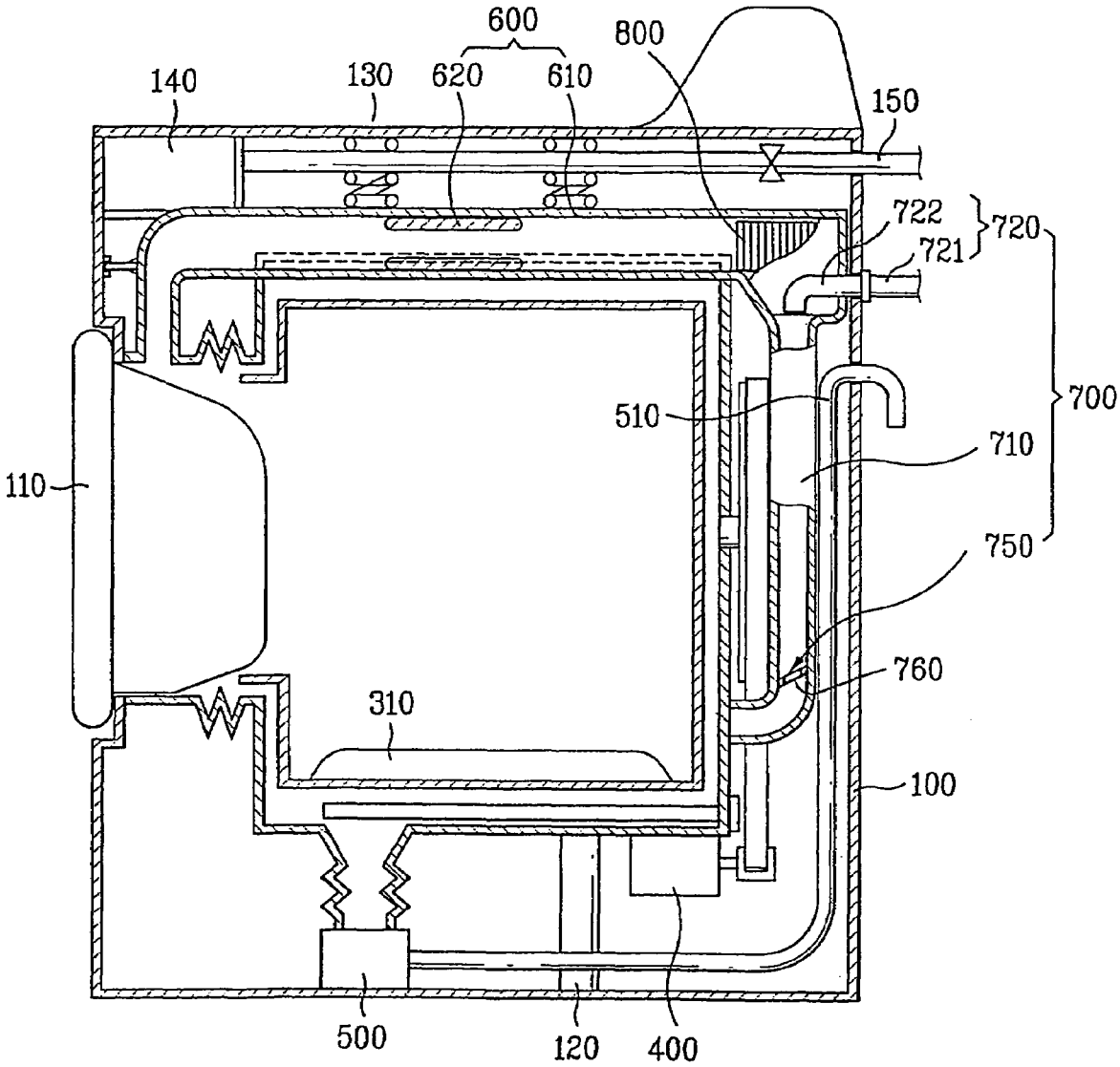
FIG. 7 and FIG. 8 are cross sectional view and front sectional view showing inner structures of a washing machine and dryer according to a second embodiment of the present invention.
Figure 8:
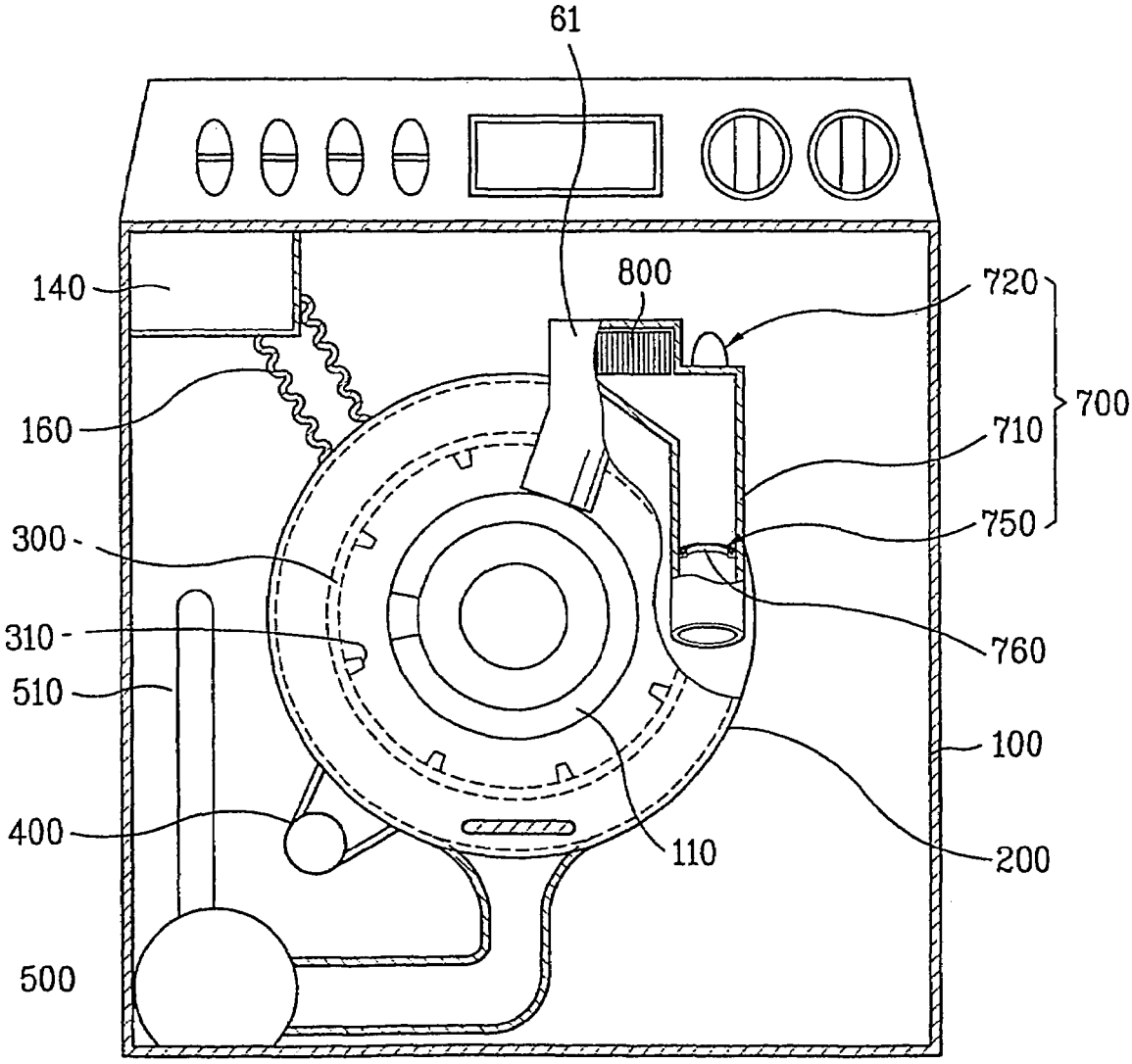

The dropping plate 755 is projected from a point on the inner surface of the condensation duct 710 toward the inner space of the condensation duct 710, and it drops to the inner space of the condensation duct 710 the cooling water that is supplied from the cooling water supply unit 720 and flows down along the inner surface of the condensation duct 710. The dropping plate 755 is formed integrally with the inner surface of the condensation duct 710 as shown in FIG. 5, or is formed by a molding process such that the condensation duct 710 itself is inwardly projected as shown in FIG. 6. The dropping plate 755 is projected to be inclined toward the lower direction of the inner space of the condensation duct 710 from the inner surface of the condensation duct 710, and has an inclination angle of approximately 45 degrees, for example.

In the first embodiment of the washing machine and dryer having the dropping plate 755 according to the present invention, an inverse current preventing plate 715 is further provided. As shown in FIGS. 5 and 6, the inverse current preventing plate 715 is projected on an upper inner surface of the condensation duct 710 at the location where the dropping plate 755 is projected, and it prevents the cooling water dropping from the dropping plate 755 from being dispersed toward an upper side by the air flowing through the inside of the condensation duct 710 and being moved toward the drying duct 610.

The inverse current preventing plate 715 constituted as above is formed integrally with the condensation duct 710 as shown in FIG. 5. However, although not shown in FIG. 5, the inverse current preventing plate 715 can be made in a structure in which the inverse current preventing plate 715 itself is protruded inwardly.

In the first embodiment having the dropping plate 755 and the inverse current preventing plate 715 constituted as above according to the present invention, the condensation duct 710 is formed such that an opposite side to the portion where the inverse current preventing plate 715 is projected is widened, which is to prevent the air passage from being narrowed at the portion where the inverse current preventing plate 715 is projected.

In the meanwhile, the washing machine having the above structure according to the present invention performs the washing through the following steps.

First, wet laundry is loaded into the drum 300. A proper amount of detergent is supplied into the detergent box 140 and washing water is supplied through the water feed tube 150, so that washing water dissolving the detergent in the detergent box 140 is introduced into the tub 200 through the water feed hose 160. If the washing water is supplied up to a level within the tub 200, the drum 300 rotates to start the washing.

If the drum 300 rotates, the laundry is lifted upwardly by the tumbling rib 310 along with the rotation of the drum 300, and is then dropped downwardly by gravity. Due to the impact force generated when the laundry is dropped, the frictional force of the washing water, and the interaction of the detergent, contamination attached to the laundry is eliminated.

After the washing is performed for a predetermined time by the rotation of the drum 300, the drain pump 500 operates to discharge the contaminated washing water outside the cabinet 100.

If the discharge of the contaminated washing water is completed, clean washing water is again supplied into the drum 300 to perform the rinsing by rotating the drum 300. After the rinsing is performed by discharging and supplying the rinsing water by several times, the rinsing water is completely discharged and the drum 300 is rotated at a fast speed, thereby removing moisture contained in the laundry by a centrifugal force.

The wet laundry which the washing, rinsing and dewatering have been completed through the aforementioned steps is completely dried in the washing machine and dryer according to the present invention by thermal wind, and its detailed description is as follows.

First, the motor 400 operates to rotate the drum 300 which wet laundry is received in its inner space. At the same time, the circulation fan 800 rotates and the heater 620 operates.

So, the air in the drum 300 is sequentially via the condensation duct 710 and the drying duct 610, and is again introduced into the drum 300. The air that is via the drying duct 610 is heated to a high temperature by the heater 620. The heated air while being via the drying duct 610, dries the laundry in the drum 300, and the moisture contained in the laundry is vaporized into the atmosphere within the drum 300.

Moist air containing the moisture vaporized from the laundry is introduced into the condensation duct 710. Meanwhile, the cooling water supply unit 720 continuously supplies cooling water to the interior of the condensation duct 710. Hence, while moist air that is via the inside of the condensation duct 710 exchanges heat with the cooling water, the moisture contained in the air is condensed and removed, so that the air is in a dry status.

Hereinafter, there is described in more detail the moisture removal procedure in the condensation unit 700 of the washing machine and dryer according to the first embodiment of the present invention.

If the dry work starts as above, cooling water is supplied into the inside of the condensation duct 710 through the cooling water supply unit 720 along with the start of the dry work or after an elapse of a predetermined time. The cooling water supplied into the interior of the condensation duct 710 flows down along the inner circumferential surface of the condensation duct 710, and exchanges heat with the moist air flowing through the inner space of the condensation duct 710 to condense the moisture in the air.

The cooling water flowing down along the inner circumferential surface of the condensation duct 710 reaches the dropping plate 755 inclinedly projected approximately at the lower inside of the condensation duct 710. The cooling water reaching the dropping plate 755 flows down along the inclined dropping plate 755, and drops from one end of the dropping plate 755 into the lower side of the inner space of the condensation duct 710.

The cooling water dropping from the dropping plate 755 contacts with and exchanges heat with the moist air flowing through the inner space of the condensation duct 710 at a wider area, so that condensation efficiency is further enhanced. As the condensation efficiency is enhanced, the air is heated in the drying duct 610 in a drier status, and then supplied to the drum 300, so that dry efficiency is also enhanced.

In the meanwhile, the cooling water dropping from the dropping plate 755 collides with the air at the head-on, so that a predetermined amount of the cooling water is dispersed upward by the flowing air. The upward dispersed cooling water collides with the inverse current preventing plate 715 projected approximately on the upper inner surface of the condensation duct 710, so that the cooling water drops downward and exchanges heat with the air. The inverse current preventing plate 715 prevents the dispersed cooling water from being moved toward the drying duct 610, and drops the upward dispersed cooling water again to thereby enhance the condensation efficiency.

The air in which moisture is removed by the above procedure is via the circulation fan 800 and is then introduced into the drying duct 610. The dry air introduced into the drying duct 610 is heated to a high temperature by the heater 620 and is again supplied into the drum 300. The laundry received in the drum 300 is completely dried by repeating the aforementioned steps.

In the first embodiment of the washing machine and dryer according to the present invention, since the dropping plate 755 drops cooling water to the inner space of the condensation duct 710 to increase the heat exchange area between the cooling water and the air, condensation efficiency and dry efficiency are enhanced.

Also, since the inverse current preventing plate 715 prevents the cooling water upward dispersed by the air from being moved toward the drying duct 610, and again drops the dispersed cooling water, disorder of the circulation fan 800 is prevented and efficiency and dry efficiency are enhanced.

In the meanwhile, a washing machine and dryer according to a second embodiment of the present invention is shown in FIGS. 7 to 11. Referring to FIGS. 7 to 11, a cooling water dropping unit 750 in the washing machine and dryer according to the second embodiment of the present invention includes a rib 760 projected along the inner circumferential surface of the condensation duct 710. Hereinafter, the structure of the rib 760 will be described in detail.

Figure 10:
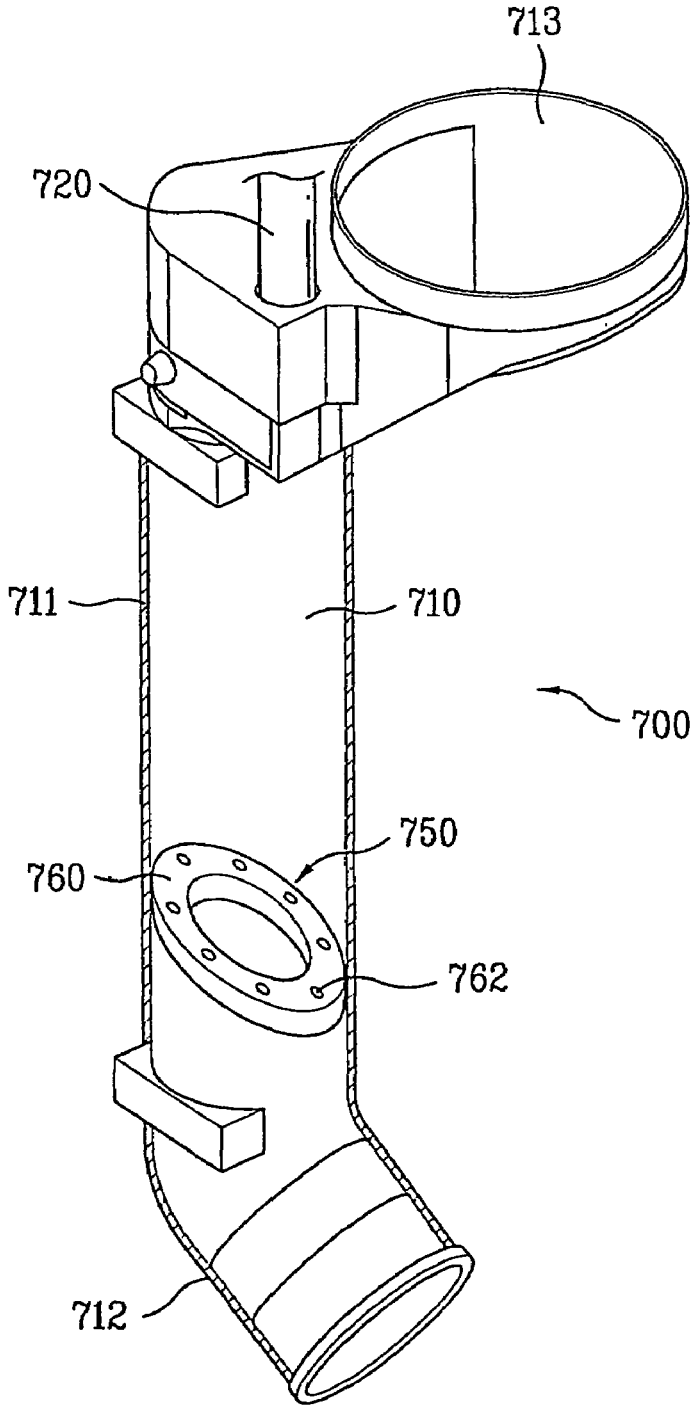
Figure 11:
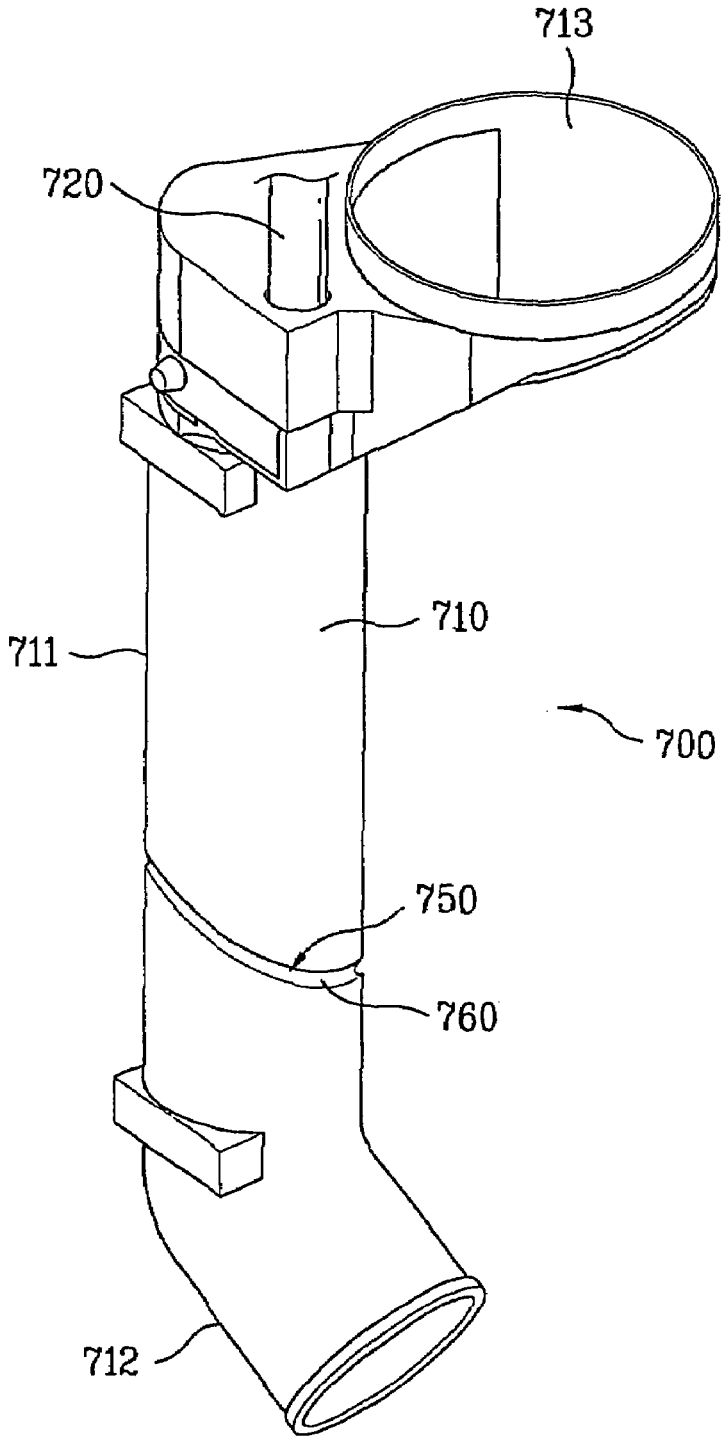
FIG. 11 is a perspective view showing another example of a cooling water dropping unit in the washing machine and dryer according to the second embodiment of the present invention.
Figure 12:
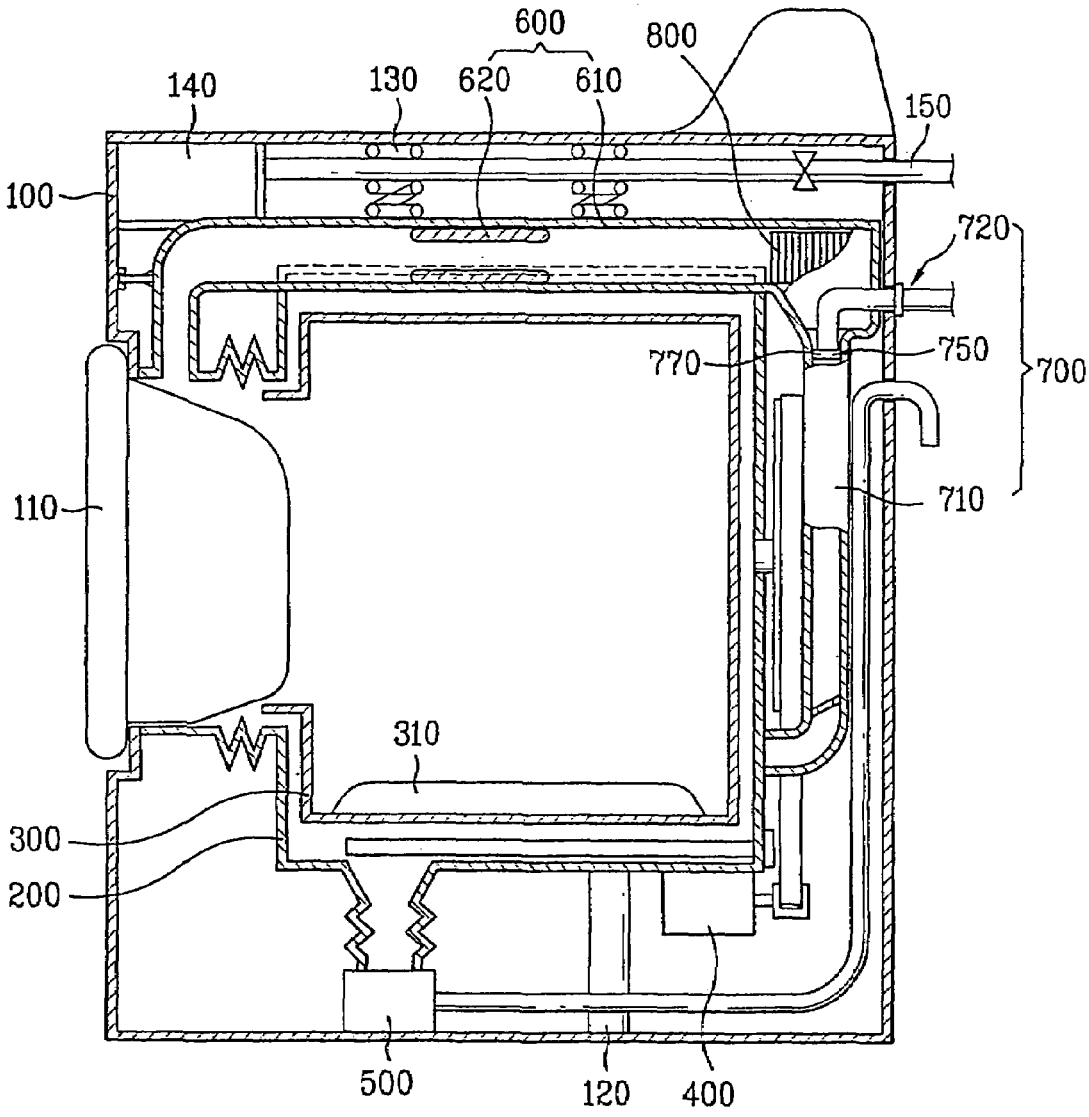
FIG. 12 and FIG. 13 are sectional views showing inner structures of the cooling water dropping unit in a washing machine and dryer according to a third embodiment of the present invention.
Figure 13:
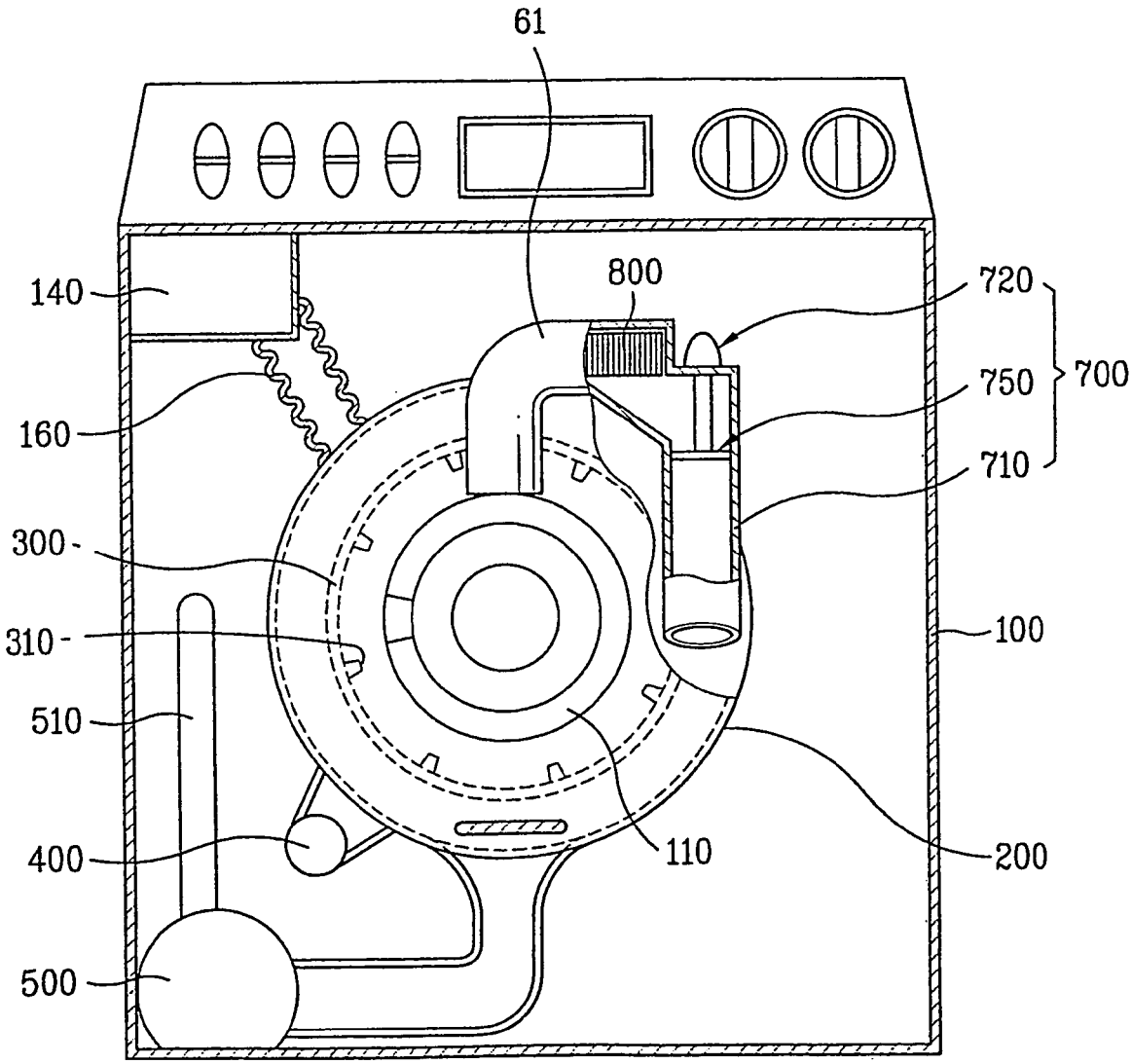

As shown in FIGS. 9 to 11, the rib 760 is formed to be projected along the inner circumferential surface of the condensation duct 710, and drops the cooling water that is supplied from the cooling water supply unit 720 and flows down along the inner surface of the condensation duct 710 into the inner space of the condensation duct 710.

The rib 760 is formed approximately at a lower side of the condensation duct 710, and it is integrally formed with the condensation duct 710 and projected as shown in FIGS. 9 and 10, or is formed by a molding process such that the condensation duct 710 itself is projected to be concaved inwardly.

Meanwhile, the rib 760 is formed inclinedly in an elliptic structure as shown in the above drawings. Also, although not shown in the drawings, the rib may be formed in a circular structure parallel to the horizontal plane. If the rib 760 is formed inclinedly, it has an inclination angle of approximately 45 degrees. If the rib 760 is formed inclinedly, it is possible to continuously drop cooling water into the inner space of the condensation duct 710 in a state that a predetermined amount of the cooling water flowing down along the inner surface of the condensation duct 710 is stored in a small space formed by an upper surface of the lower side of the rib 760 and the inner surface of the condensation duct 710. In addition, if the rib 760 is installed parallel to the horizontal plane, it becomes possible to uniformly drop the cooling water into the inner space of the condensation duct 710.

Meanwhile, in order to drop the cooling water more effectively, at least one slit 761 or dropping hole 762 is formed to penetrate the rib 760 in upward and downward directions. These slit 761 and dropping hole 762 drop the cooling water that flows down along the inner surface of the condensation duct 710 and reaches the rib 760, respectively at several points.

In case the rib 760 is formed inclinedly, the slit 761 may include a plurality of slits arranged in the circumferential direction, and the dropping hole 762 may include a plurality of dropping holes arranged in the circumferential direction. In addition, in case the rib 760 is formed inclinedly, although not shown in the drawings, the slit 761 and the dropping hole 762 may be formed approximately at a lower side of the inclinedly formed rib 760 so as to drop the cooling water that flows down along the upper surface of the inclined rib 760 and is then stored by a predetermined amount in the upper surface of the lower side thereof.

In case the slit 761 is formed in the rib 760, the slit 761 may be formed to cross the width direction of a part of the rib 760 having a loop. In other words, the slit 761 is formed long from the inner circumferential portion to the outer circumferential portion of the rib 760. If the slit 761 is formed as above, the cooling water flows down through the slit 761 in a shape having a wider plane from a portion contacting with the inner. circumferential surface of the condensation duct 710 to the inner space of the condensation duct 710. Meanwhile, although not shown in the drawings, the slit 761 may be formed approximately at a middle position from the inner circumferential portion to the outer circumferential portion of the rib 760 without completely crossing the width direction of a part of the rib 760. If the slit 761 is formed as above, the cooling water drops only to the inner space of the condensation duct 710 through the slit 761.

Description overlapping with the description of the first embodiment is omitted while describing different constitution and operation of the washing machine and dryer according to the second embodiment of the present invention. In addition, when the washing machine and dryer according to the present invention performs the dry work, the dropping principle and procedure of the cooling water by the cooling water dropping unit 750 are omitted because they were described along with the structural description of the cooling water dropping unit 750. Only advantages of the washing machine and dryer according to the second embodiment of the present invention are described herein.

Since the rib 760 drops the cooling water flowing down along the inner surface of the condensation duct 710 to the inner space of the condensation duct 710, condensation efficiency and dry efficiency are enhanced.

Also, since a predetermined amount of the cooling water is collected at the lower portion of the inclinedly installed rib 760, the dropping hole 762 and the slit 761 and then a large amount of the cooling water drops, the cooling water exchanges heat with the air effectively without being dispersed into the air, so that condensation efficiency and dry efficiency are enhanced.

In addition, the rib 760 has a simple structure. If the rib 760 is formed by a molding process such that the condensation duct 710 is inwardly concaved, it is possible to fabricate the rib at a low cost.

In the washing machine and dryer according to the present invention, the cooling water dropping unit 750 may include a distribution means 770. The distribution means 770 is supplied with the cooling water from the cooling water supply unit 720 to drop the supplied cooling water to the inside of or the inner circumferential surface of the condensation duct 710.

A washing machine and dryer according to a third embodiment of the present invention is shown in FIGS. 12 to 19. Referring to. FIGS. 12 to 19, the distribution means 770 in the washing machine and dryer includes a connection tube 771 and a distribution loop 772.

Figure 14:
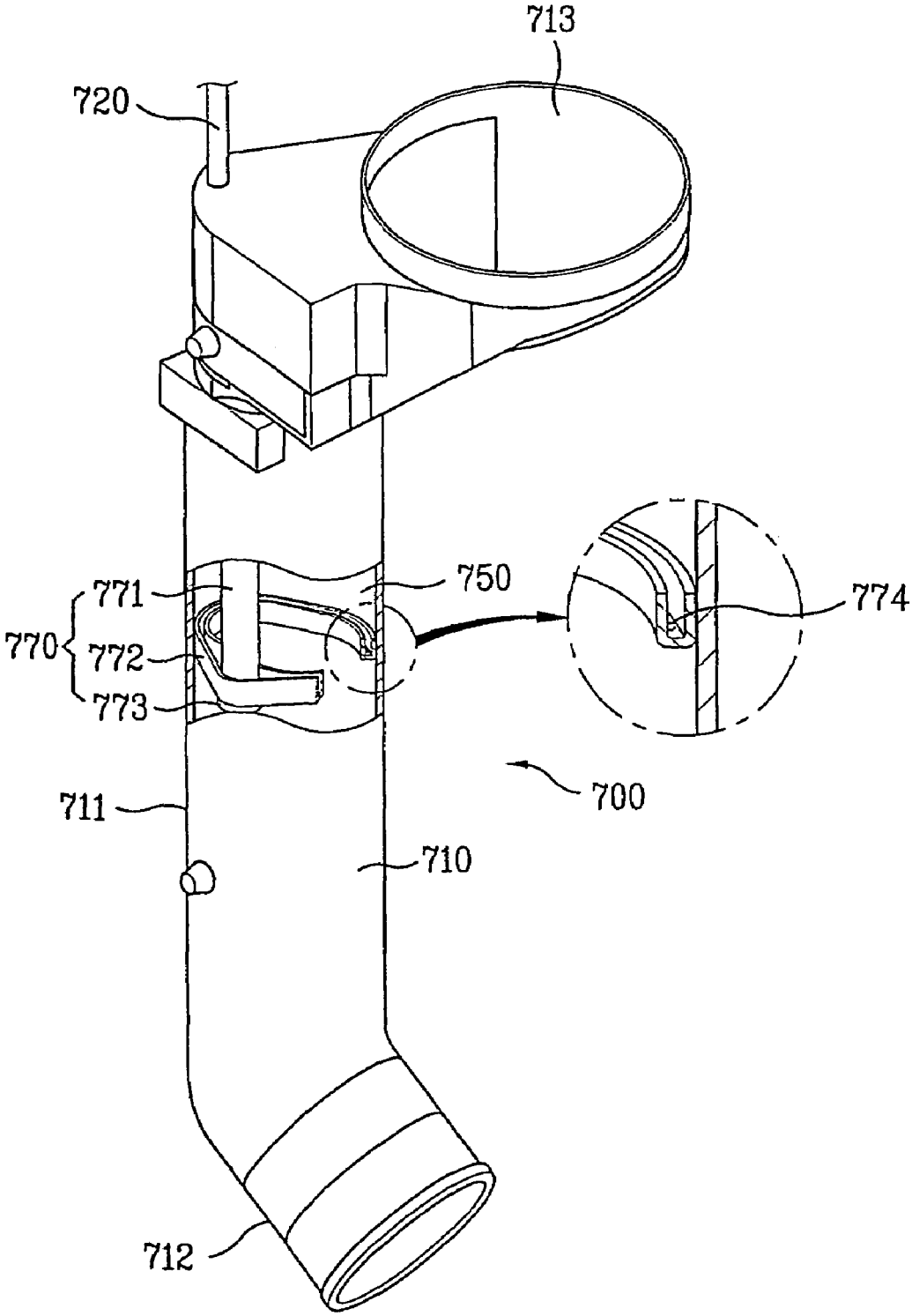
FIG. 14 is a partial sectional view of distribution means in a washing machine and dryer according to the third embodiment of the present invention.

The connection tube 771 is, as shown in FIG. 14, connected with the cooling water supply unit 720 and is supplied with the cooling water.

Figure 15:
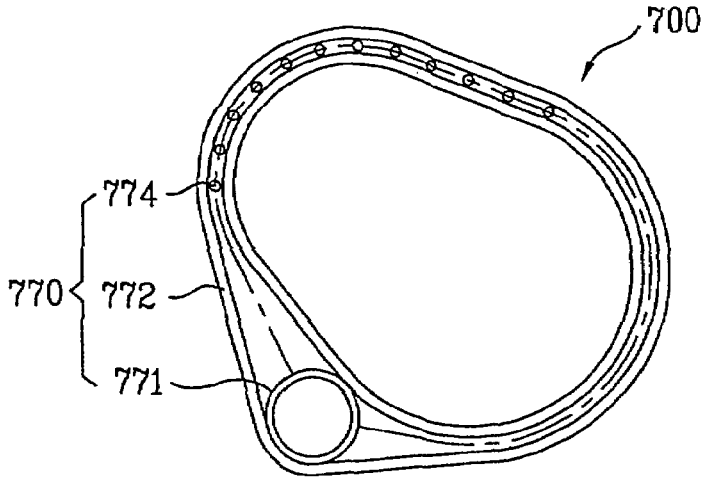
FIG. 15 is a plan view of the distribution means in FIG. 14.

The distribution loop 772 connected with the connection tube 771 to uniformly drop the cooling water to the inside of or the inner circumferential surface of the condensation duct 710. As shown in FIGS. 14, 17 to 19, the distribution loop has a cross section shaped in a channel, for example, the letter of "U". Alternatively, the distribution loop 772 may be made in another shape, for example, a tube shape. As shown in FIG. 15, the distribution loop 772 has a widened portion connected with the connection tube 771.

In the washing machine and dryer according to the third embodiment of the present invention, a plurality of injection holes 774 are formed at the distribution loop of the distribution means 770. The injection holes 774 are formed at a lower side of the distribution loop 772 in upward and downward directions to drop the cooling water supplied to the distribution loop 772 through the connection tube 771 to the inner space of the condensation duct 710. If the cooling water is dropped through the plurality of injection holes 774, heat exchange area increases while the dropped cooling water is in contact with the air flowing through the inside of the condensation duct.

Figure 17:
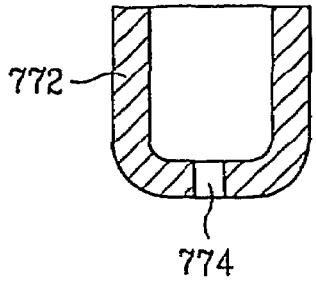
FIG. 17 to FIG. 19 are sectional views showing that the locations of injection holes in the distribution means are different from one another.

Meanwhile, as shown in FIG. 17, the injection holes 774 may be formed along a lower center portion of a cross section of the distribution loop 772. If the injection holes 774 are formed as above, the cooling water supplied to the distribution loop 772 is uniformly distributed at a state spaced by a predetermined distance from the inner circumferential surface of the condensation duct 710 and is dropped.

Figure 18:
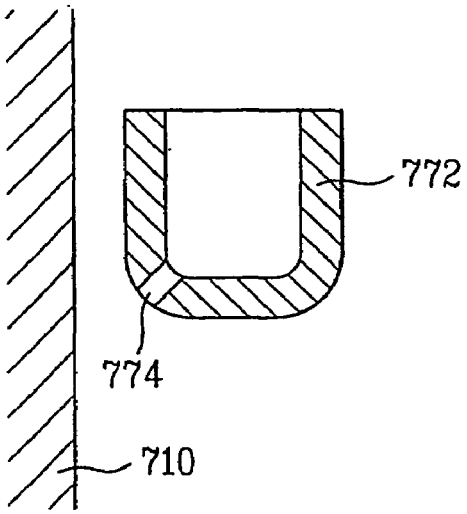
Figure 19:
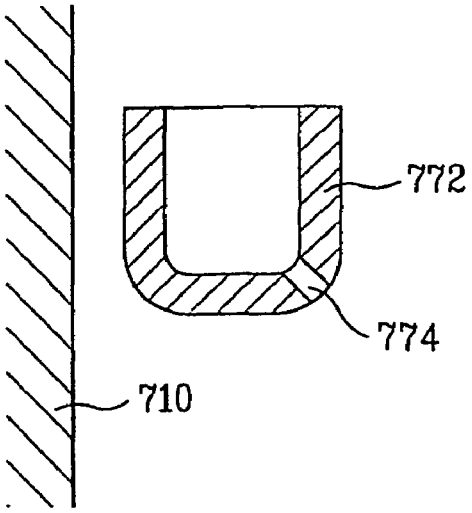

Also, as shown in FIGS. 18 and 19, the plurality of injection holes 774 may be formed along a portion of the lower side of the cross section of the distribution loop 772. In this case, the injection holes 774 may be formed inclined from an upper side to a lower side thereof. If the injection holes 774 are formed inclined toward the outer circumferential surface of the distribution loop 772 as shown in FIG. 18, the cooling water within the distribution loop 772 is injected toward the inner circumferential surface of the condensation duct 710. Thus, it is possible to uniformly distribute the cooling water supplied to the distribution loop 772 along the inner circumferential surface of the condensation duct 710 and flow it down. Accordingly, if the condensation unit 700 is made in combination with the first and second embodiments of the washing machine and dryer according to the present invention, it becomes possible to further enhance the condensation efficiency and the dry efficiency. Meanwhile, as shown in FIG. 19, if the injection holes 774 are formed inclined toward the inner circumferential surface of the distribution loop 772, the cooling water within the distribution loop 772 drops to the center of the inner space of the condensation duct 710. Thus, if the cooling water drops to the center of the inner space of the condensation duct 710 where the flow speed of the air is fast, an effective heat exchange area per unit time and unit area in which heat exchange is performed by a contact with the air increases compared with a case that the cooling water drops through another portion, so that condensation efficiency and dry efficiency are enhanced.

Figure 16:
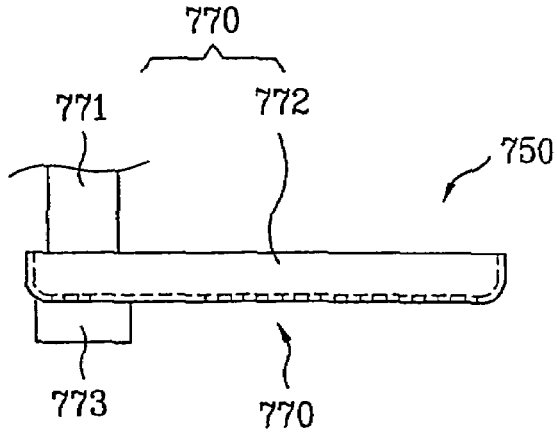
FIG. 16 is a side view of the distribution means in FIG. 14.

In the meanwhile, in the washing machine and dryer according to the third embodiment of the present invention, the distribution means 770, as shown in FIGS. 14 to 16, may further include a storage tank 773. The storage tank 773 is provided to store a predetermined amount of the cooling water at a portion where the connection tube 771 and the distribution loop 772 are connected with each other. Thus, if the storage tank 773 is provided, it serves as a kind of manhole. Accordingly, the cooling water supplied through the connection tube 771 is uniformly supplied to several places. In addition, if the storage tank 773 is provided, the cooling water is maintained at a full status at a portion where the connection tube 771 and the distribution loop 772 are connected with each other. Accordingly, it is prevented that the air flowing through the inside of the condensation duct 710 is leaked to the outside through the connection tube 771.

In the aforementioned washing machine and dryer according to the third embodiment of the present invention, description on the elements and operation overlapping with the elements and operation of the first and second embodiments is omitted while describing different constitution and operation of the washing machine and dryer according to the third embodiment of the present invention. In addition, when the washing machine and dryer according to the present invention performs the dry work, the dropping principle, procedure and effects of the cooling water by the cooling water dropping unit 750 are omitted because they were described along with the structural description of the cooling water dropping unit 750.

In the meanwhile, in the washing machine and dryer according to the present invention, the distribution means 770 includes a guide passage. Various modifications of the distribution means 770 including the guide passage in a fourth embodiment of the present invention are shown in FIGS. 20 and 21.

Figure 20:
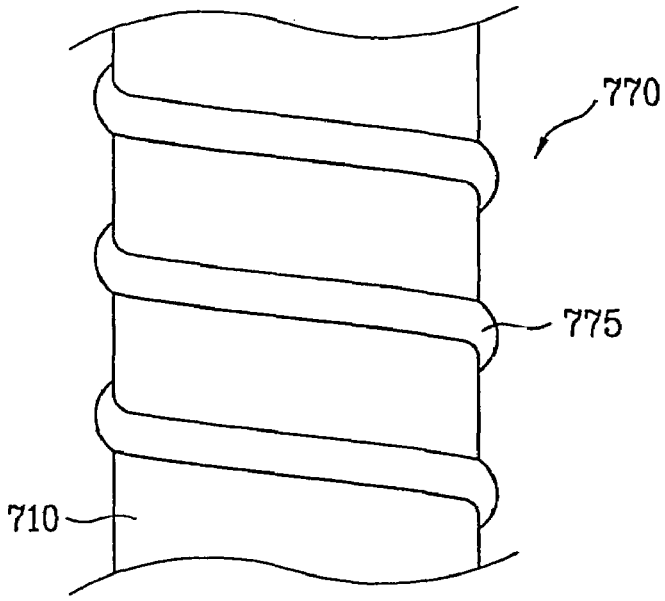
FIG. 20 is a partial perspective view of a guide passage in a washing machine and dryer according to a fourth embodiment of the present invention.
Figure 21:
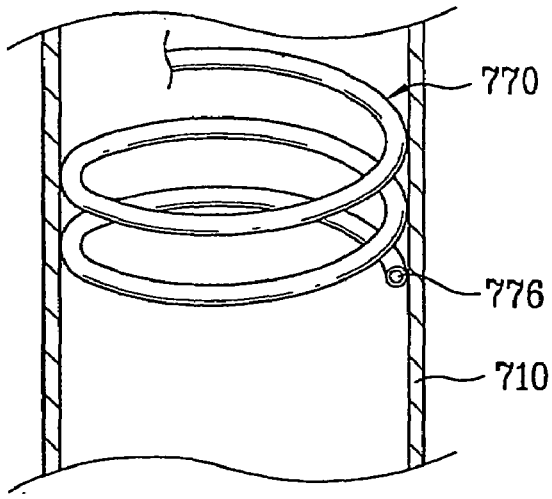
FIG. 21 is a partial sectional view of another guide passage in a washing machine and dryer according to the fourth embodiment of the present invention.

Referring to FIGS. 20 and 21, the guide passage is formed in a spiral structure at the inner surface of the condensation duct 710 so as to guide the cooling water supplied from the cooling water supply unit 720 and uniformly distribute and flow the guided cooling water on the inner circumferential surface of the condensation duct 720. The guide passage is formed approximately at an upper side of the condensation duct 710.

Referring to FIG. 20, the guide passage is made in a guide groove 775, and the guide groove 775 is formed concave when viewed from the inside of the condensation duct 710, but is formed convex when viewed from the outside of the condensation duct 710.

If the guide groove 775 is formed as above, the cooling water supplied to the condensation duct 710 from the cooling water supply unit 720 is guided to the guide groove 775, and the guided cooling water flows down the condensation duct 710 with forming a spiral trace along the guide groove 775. From a point where the guide groove 775 disappears, the cooling water flows down along the inner surface of the condensation duct 710 with continuously forming the spiral trace.

Thus, since the cooling water flows down in a state that the cooling water is uniformly distributed on the inner surface of the condensation duct 710 by the guide groove 775, the condensation efficiency and the dry efficiency are enhanced. Of course, it is possible to combine the present embodiment with the first and second embodiments. If the combination is performed, the condensation efficiency and the dry efficiency are further enhanced.

In the meanwhile, in case the guide passage is made in the form of the guide groove 775, its structure is very simple. Accordingly, by fabricating a mold having the guide groove 775 on producing the condensation duct, the guide passage can be fabricated at a very low cost by a simple molding process.

Figure 2:
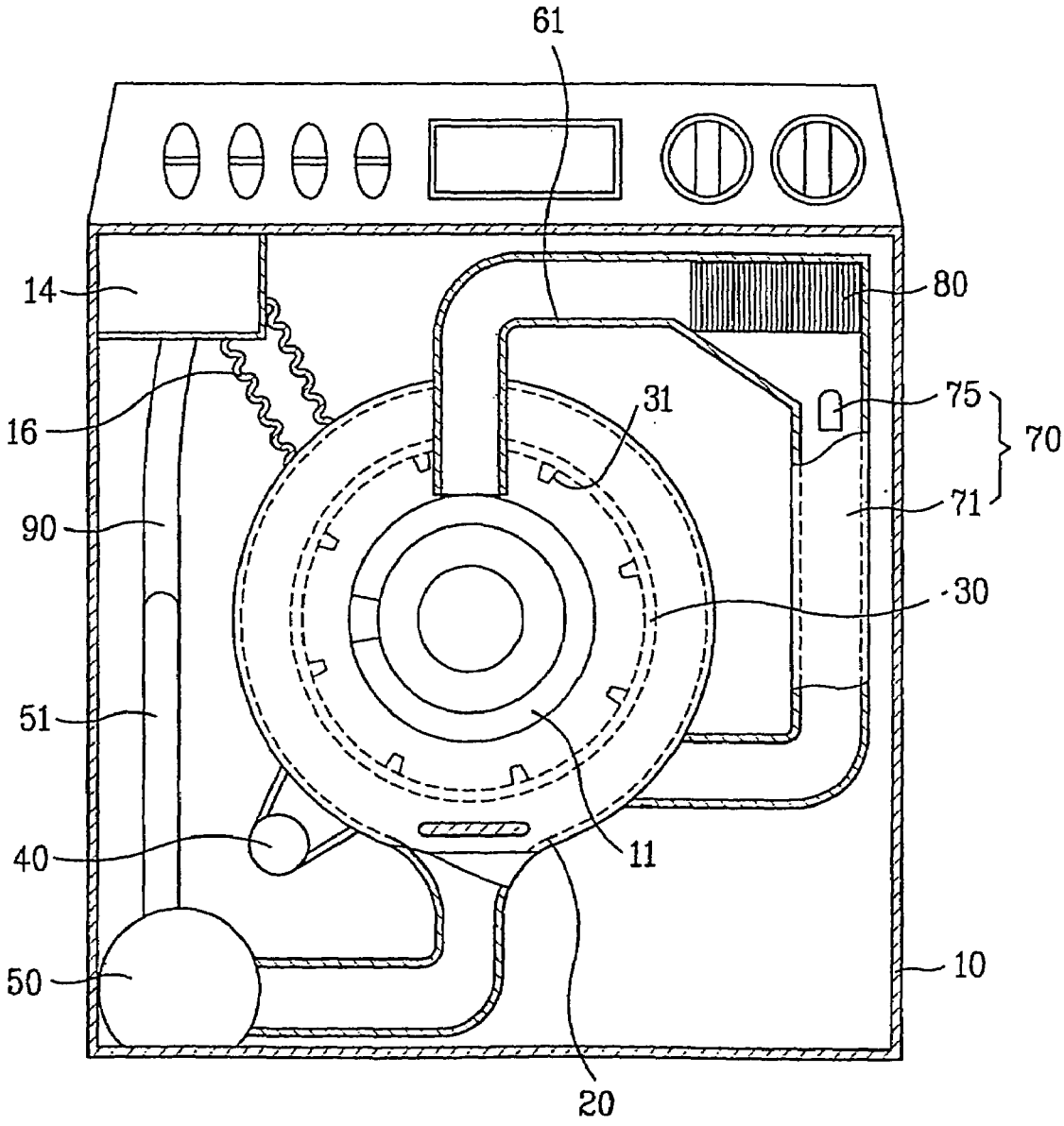

Referring to FIG. 2, the guide passage includes a guide tube. Here, the guide tube 776 is a spiral guide tube, and the cooling water supplied from the cooling water supply unit 720 flows into the inside of the guide tube 776. For this purpose, the upper end of the guide tube 776 is connected with or installed adjacent to the cooling water supply unit 720, for instance, the water feed nozzle 722.

If the guide passage is installed as above, the cooling water supplied into the condensation duct 710 through the cooling water supply unit 720 is introduced into the guide tube 776, flows through with forming a spiral trace, and is then discharged from a lower end of the guide tube 776. The discharged cooling water flows down along the inner circumferential surface of the condensation duct 710 with forming a spiral trace by an inertia force, so that the condensation efficiency and the dry efficiency are enhanced.

In the meanwhile, although not shown in the drawings, a distribution hole may be provided in the guide tube 776 similarly to the washing machine and dryer according to the third embodiment of the present invention.

The distribution hole may be formed at a lower side of the guide tube 776 by plurality. Similarly to the above, the plurality of distribution holes may be arranged eccentrically toward the lower center of, or one side of the guide tube 776, or may be formed inclinedly toward the inner circumferential surface or the outer circumferential surface of the guide tube 776.

Since the constitution of the distribution holes is nearly the same as that of the injection holes 774, its detailed description will be omitted. Only when the distribution holes are formed in the guide tube 776 like the above, a part of the cooling water introduced into the guide tube 776 is uniformly distributed on the inner surface of the condensation duct 710 and flows down, while other part of the cooling water drops to the inner space of the condensation duct 710 through the distribution holes. Accordingly, the condensation efficiency and the dry efficiency are enhanced.

While only the guide groove 775 and the guide tube 776 as the embodiments of the guide passage on the present specification has been described and illustrated herein, it will be apparent to those skilled in the art that various modifications and variations can be made therein without departing from the spirit and scope of the invention. For instance, the guide tube may be formed to have a section similar to the U-shaped section, or formed to be projected in a spiral structure at the inner circumferential surface of the condensation duct 710.

Figure 22:
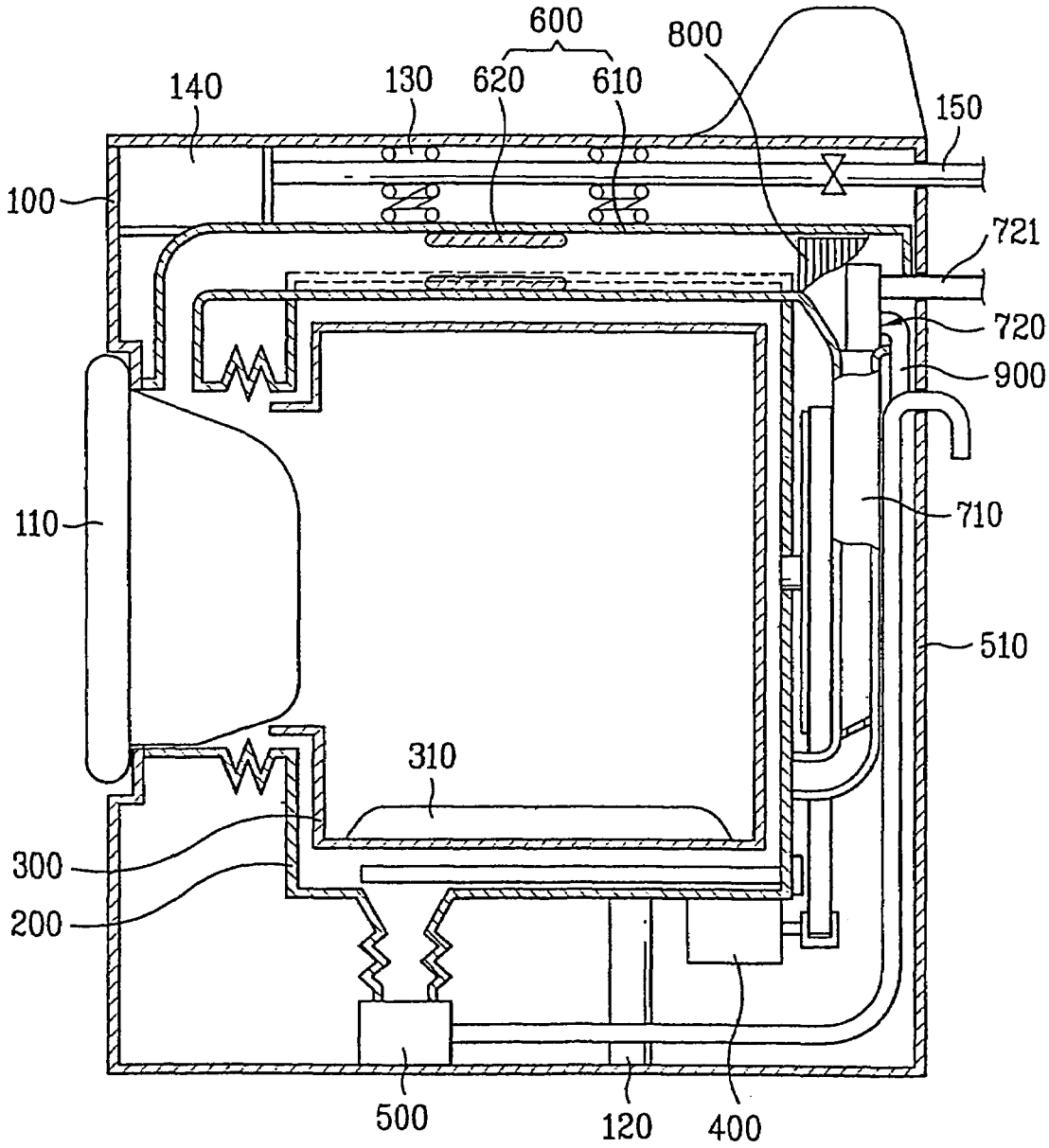
FIG. 22 and FIG. 23 are cross sectional view and front sectional view showing inner structures of a washing machine and dryer according to a fifth embodiment of the present invention.
Figure 23:
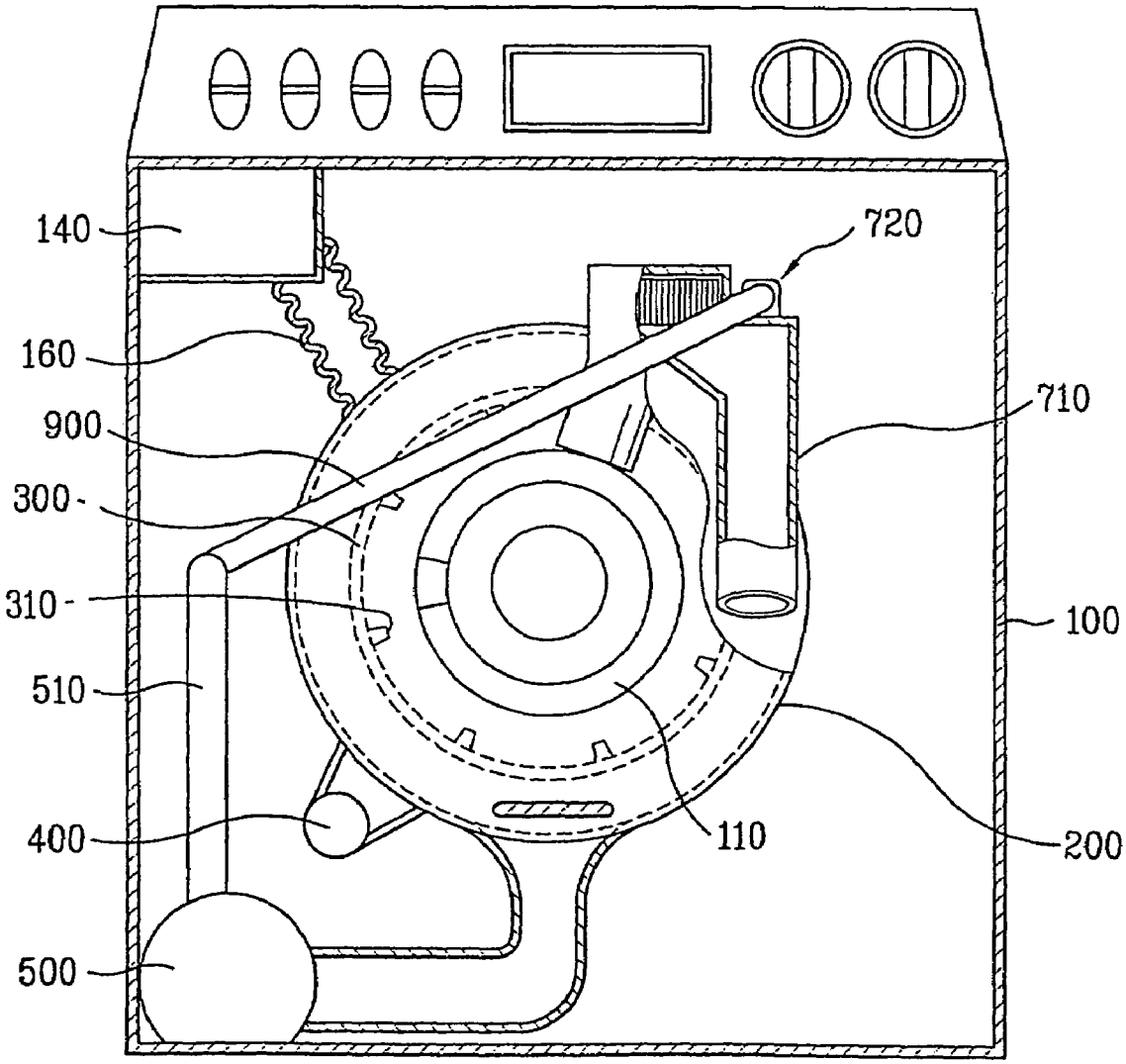
Figure 24:
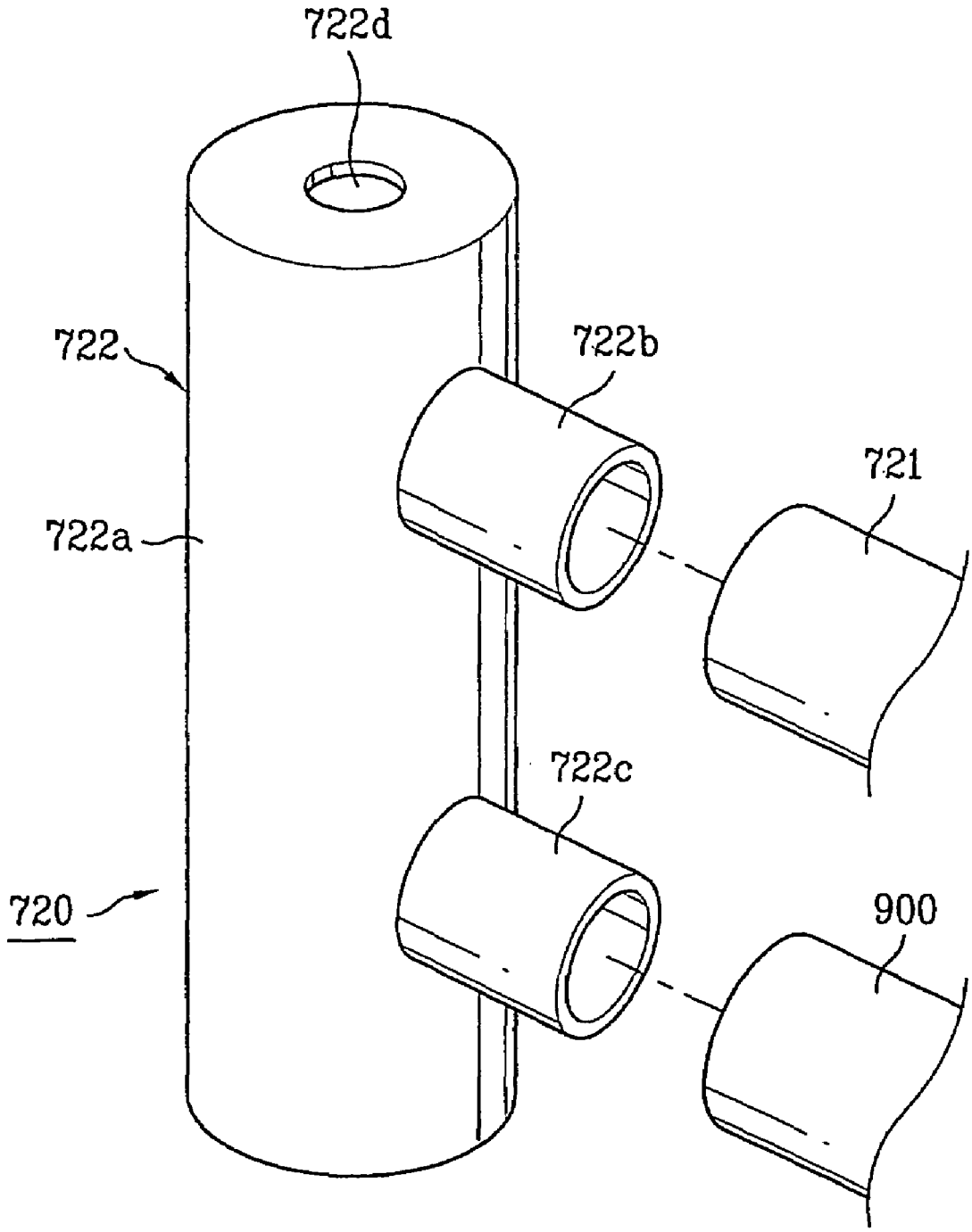
FIG. 24 is a disassembled perspective view of a cooling water supply unit in a washing machine and dryer according to the fifth embodiment of the present invention.

A washing machine and dryer according to a fifth embodiment of the present invention is well shown in FIGS. 22 to 24. Referring to FIGS. 22 to 24, the washing machine and dryer further includes a siphon hose 900.

As shown in FIGS. 22 and 23, the siphon hose 900 is installed to connect a drain hose 510 with the cooling water supply unit 720, and supplies the inversely flowing washing water to the cooling water supply unit 720 when the washing water inversely flows through the drain hose 510 due to various factors such as the drain pressure during the discharge of the washing water.

For this purpose, the cooling water supply unit 720 according to the fifth embodiment of the present invention is constituted to supply the washing water inversely flowing through the drain hose 510 as well as the cooling water supplied through the water feed hose 721, to the inside of the condensation duct 710. Hereinafter, a detailed constitution of the cooling water supply unit 720 will be described with reference to the accompanying drawings.

Referring to FIG. 24, the cooling water supply unit 720 according to the fifth embodiment of the present invention includes a water feed tube 721 and a water feed nozzle 722.

The water feed tube 721 is installed to penetrate the cabinet 100, and the cooling water supplied from an outside flows through the water feed tube 721.

The water feed nozzle 722 is connected with the water feed tube 721 and the siphon hose 900 respectively, and supplies the cooling water to the inside of the condensation duct 710. This water feed nozzle 722 includes a nozzle body 722*a*, a first connection hole 722*b* and a second connection hole 722*c*.

The nozzle body 722*a* is made in a cylinder shape of which one end is opened. The first connection hole 722*b* is formed at one side of the nozzle body 722*a*, and is connected with the water feed tube 721. The second connection hole 722*c* is formed at another side of the nozzle body 722*a*, and is connected with the siphon hose 900.

In addition, an air hole 722*d* is further formed at one side of the nozzle body 722*a* constituted as above, for example, a closed end of the nozzle body 722*a*. This air hole 722*d* maintains the inside and the outside of the condensation duct 710 at a constant pressure to permit the washing water introduced from the siphon hose 900 from being injected through the nozzle body 722*a* with ease.

In the washing machine and dryer having the aforementioned structure according to the fifth embodiment of the present invention, a procedure in which the washing water inversely flowing through the drain hose 510 is supplied into the condensation duct 710 will be described hereinafter.

If the washing water that is being discharged through the drain hose 510 inversely flows toward the inside of the cabinet 100 owing to a nonpredictable factor, the inversely flowing washing water is introduced into the siphon hose 900. The washing water introduced toward the siphon hose 900 is introduced into the inside of the nozzle body 722*a* through the second connection hole 722*c* and then supplied to the inside of the condensation duct 710.

Thus, in the washing machine and dryer according to the fifth embodiment of the present invention, since the inversely flowing washing water is supplied to the inside of the condensation duct 710 and flows out, there does not occur a problem in that the washing water is introduced into the drum 300 although the amount of the inversely flowing washing water is excessive.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

Industrial Applicability

The advantages of the washing machine and dryer having the aforementioned constitution according to the present invention were described in the respective embodiments. Accordingly, hereinafter, these advantages are summarized. However, it is intended that the present invention is not limited to the following advantages but covers all the contents contained in the specification.

First, in the washing machine and dryer according to the present invention, since the cooling water dropping unit 750 drops the cooling water to the inner space of the condensation duct, heat exchange area between the cooling water and the air increases, so that the condensation efficiency and the dry efficiency are enhanced.

Second, in the washing machine and dryer according to the present invention, since the condensation unit 700 has a superior condensation efficiency, it is possible to design the condensation duct 710 smaller and shorter, so that the space utilization of the cabinet is enhanced and thus the washing machine and dryer is made to a compact structure.

Third, in the washing machine and dryer according to the present invention, since the superior condensation efficiency of the condensation unit 700 can be installed in a linear type unlike the related art in which the condensation unit 700 is installed long in an oblique line direction, its assembling and installation processes are easy.

Fourth, in the washing machine and dryer according to the fifth embodiment of the present invention, since the inversely flowing washing water is allowed to flow through the inside of the condensation duct 710 by using the siphon hose 900, there does not occur a problem in that the inversely flowing washing water is again introduced into the drum 300 to contaminate the laundry.

What is claimed is:

1. A washing machine and dryer comprising:

a cabinet;

a tub provided in the cabinet;

a drying unit including a drying duct of which one end is connected with an interior of the tub, and a heater provided in the tub;

a condensation unit including;

a condensation duct of which one end is connected with the drying duct and the other end is connected with the tub, and through which air in the tub passes, a cooling water supply unit, which supplies cooling water supplied from an outside to the interior of the condensation duct to contact the air passing through the condensation duct with the cooling water, and a cooling water dropping unit, which collects the cooling water supplied to an interior of the condensation duct and drops the cooling water to an interior space of the condensation duct;

a circulation fan, which circulates the air in the tub via the condensation duct and the drying duct;

a drain pump, which discharges washing water in the tub outside the cabinet; and a siphon hose connecting a drain hose connected with the drain pump with the cooling water supply unit.

2. The washing machine and dryer of claim 1, wherein the heater is installed in the drying duct.

3. The washing machine and dryer of claim 1, wherein the circulation fan is installed at a connecting portion of the drying duct and the condensation duct.

4. The washing machine and dryer of claim 1, wherein the condensation duct comprises:

a middle part extending in the upward and downward direction;

a lower part extending from a lower end of the middle part and connected with the tub; and an upper part extending from an upper end of the middle part and connected with the drying duct.

5. The washing machine and dryer of claim 4, wherein the middle part is shaped in a cylinder.

6. The washing machine and dryer of claim 4, wherein the lower part is curved in a direction into which air is introduced so as to lower resistance of the air introduced from the tub.

7. The washing machine and dryer of claim 4, wherein the upper part is formed in a wide step shape at one side of the middle part.

8. The washing machine and dryer of claim 1, wherein the cooling water dropping unit comprises a dropping plate projected from one side of inner surface of the condensation duct so as to drop the cooling water flowing down along the inner surface of the condensation duct into the inner space of the condensation duct.

9. The washing machine and dryer of claim 8, wherein the dropping plate is integrally formed in the inner surface of the condensation duct.

10. The washing machine and dryer of claim 8, wherein the dropping plate is formed by a molding process such that the condensation duct is projected inwardly.

11. The washing machine and dryer of claim 8, wherein the dropping plate is projected to be inclined toward the downward direction of the inner space of the condensation duct from the inner surface of the condensation duct.

12. The washing machine and dryer of claim 11, wherein the dropping plate is inclined at an angle of approximately 45 degree.

13. The washing machine and dryer of claim 8, further comprising an inverse current preventing plate which is projected from the inner surface of the condensation duct at the upper side of the dropping plate so as to prevent the cooling water dropping from the dropping plate from being dispersed toward the upper side by the air flowing through the condensation duct and moved toward the drying duct.

14. The washing machine and dryer of claim 13, wherein the inverse current preventing plate is integrally formed with the condensation duct.

15. The washing machine and dryer of claim 13, wherein the condensation duct has a widened portion at an opposite side to a portion where the inverse current preventing plate projected so as to prevent air passage of the portion where the inverse current preventing plate projected from being narrowed.

16. The washing machine and dryer of claim 1, wherein the cooling water dropping unit comprises a rib projected in the form of a loop along an inner circumferential surface of the condensation duct so as to drop the cooling water flowing down along the inner surface of the condensation duct into the inner space of the condensation duct.

17. The washing machine and dryer of claim 16, wherein the rib is formed approximately at a lower side of the condensation duct.

18. The washing machine and dryer of claim 16, wherein the rib is integrally formed with the condensation duct.

19. The washing machine and dryer of claim 18, wherein the rib has an inclination angle of approximately 45 degree.

20. The washing machine and dryer of claim 16, wherein the rib is formed by a molding process such that the condensation duct itself is projected inwardly.

21. The washing machine and dryer of claim 16, wherein the rib is formed in an elliptic structure.

22. The washing machine and dryer of claim 21, wherein the rib has at least one slit for dropping the cooling water inclinedly flowing down along an upper surface of the rib toward the lower side.

23. The washing machine and dryer of claim 22, wherein the slit comprises a plurality of slits arranged in a circumferential direction of the rib.

24. The washing machine and dryer of claim 22, wherein the slit is formed approximately at a lower side of the rib installed inclinedly.

25. The washing machine and dryer of claim 22, wherein the slit is formed to cross a part of the rib from as inner circumferential portion to an outer circumferential portion of the rib.

26. The washing machine and dryer of claim 22, wherein the slit is formed approximately at a middle position from inner circumferential portion to an outer circumferential portion of the rib.

27. The washing machine and dryer of claim 21, wherein the rib has at least one dropping hole for dropping the cooling water inclinedly flowing down along an upper surface of the rib toward a lower side.

28. The washing machine and dryer of claim 27, wherein the dropping hole comprises a plurality of dropping holes arranged in a circumferential direction of the rib.

29. The washing machine and dryer of claim 27, wherein the dropping hole is formed approximately at a lower side of the rib installed inclinedly.

30. The washing machine and dryer of claim 16, wherein the rib is formed horizontally in a circular structure.

31. The washing machine and dryer of claim 30, wherein the rib comprises at least slit for dropping the cooling water flowing down along the inner surface of the condensation duct toward a lower side.

32. The washing machine and dryer of claim 31, wherein the slit comprises a plurality of slits arranged in a circumferential direction of the rib.

33. The washing machine and dryer of claim 31, wherein the slit is formed to cross a part of the rib from an inner circumferential portion to an outer circumferential portion of the rib.

34. The washing machine and dryer of claim 31, wherein the slit is formed approximately at a middle position from an inner circumferential portion to an outer circumferential portion of the rib.

35. The washing machine and dryer of claim 30, wherein the rib has at least one dropping hole formed in upper and lower directions, for dropping the cooling water flowing down along an inner surface of the condensation duct rib toward a lower side.

36. The washing machine and dryer of claim 35, wherein the dropping hole comprises a plurality of dropping holes arranged in a circumferential direction of the rib.

37. The washing machine and dryer of claim 1, wherein the cooling water dropping unit comprises a distribution means- which is supplied with the cooling water from the cooling water supply unit to drop the supplied cooling water to the inside of or an inner circumferential surface of the condensation duct.

38. The washing machine, and dryer of claim 37, wherein the distribution means comprises:

a connection tube connected with the cooling water supply unit, for being supplied with the cooling water; and a distribution loop connected with the connection tube, for uniformly dropping the cooling water to the inside of or the inner circumferential surface of the condensation duct.

39. The washing machine and dryer of claim 38, further comprising a plurality of injection holes formed at a lower side of the distribution loop, for injecting the cooling water.

40. The washing machine and dryer of claim 39, wherein the plurality of injection holes are formed along a lower center portion of a cross section of the distribution loop such that the cooling water drops to the inner space of the condensation duct.

41. The washing machine and dryer of claim 39, wherein the plurality of injection holes are formed along a portion of a lower side of the cross section of the distribution loop.

42. The washing machine and dryer of claim 41, wherein the plurality of injection holes are formed inclined from an upper side to a lower side thereof.

43. The washing machine and dryer of claim 42, wherein the plurality of injection holes are inclined toward an outer circumferential surface of the distribution loop such that the cooling water within the distribution loop is injected toward the inner circumferential surface of the condensation duct.

44. The washing machine and dryer of claim 42, wherein the plurality of injection holes are inclined toward an inner circumferential surface of the distribution loop such that the cooling water within the distribution loop is injected toward an inner space of the condensation duct.

45. The washing machine and dryer of claim 38, further comprising a storage tank for storing a predetermined amount of the cooling water at a portion where the connection tube and the distribution loop are connected with each other.

46. The washing machine and dryer of claim 37, wherein the distribution means is a guide passage formed in a spiral structure at an inner surface of the condensation duct so as to guide the cooling water supplied from the cooling water supply unit and uniformly distribute and flow the guided cooling water on the inner circumferential surface of the condensation duct.

47. The washing machine and dryer of claim 37, wherein the distribution loop has a cross section shaped in the letter of "U".

48. The washing machine and dryer of claim 37, wherein the distribution loop has a widened portion connected with the connection tube.

49. The washing machine and dryer of claim 46, wherein the guide passage is formed approximately at an upper side of the condensation duct.

50. The washing machine and dryer of claim 46, wherein the guide passage is comprised of a spiral groove which is formed to-be convex from the inner surface side to the outer surface side.

51. The washing machine and dryer of claim 46, wherein the guide passage is comprised of a spiral guide tube which is installed such that the cooling water supplied from the cooling water supply unit flows into the inside of the guide tube.

52. The washing machine and dryer of claim 51, further comprising a plurality of distribution holes formed at a lower side of the guide tube, for injecting the cooling water.

53. The washing machine and dryer of claim 52, wherein the plurality of distribution holes are formed along a center portion of the lower side of a cross section of the guide tube such that the cooling water drops to the inner space of the condensation duct.

54. The washing machine and dryer of claim 52, wherein the plurality of distribution holes are formed along one side of the lower side of the cross section of the guide tube.

55. The washing machine and dryer of claim 54, wherein the plurality of distribution holes are formed inclined from an upper side to a lower side thereof.

56. The washing machine and dryer of claim 54, wherein the plurality of distribution holes are inclined toward the inner circumferential surface of the condensation duct such that the cooling water within the guide tube is injected toward the inner circumferential surface of the condensation duct.

57. The washing machine and dryer of claim 54, wherein the plurality of distribution holes are inclined toward an inner center of the condensation duct such that the cooling water within the guide tube is injected toward the inner space of the condensation duct.

58. The washing machine and dryer of claim 1, wherein the cooling water supply unit comprises:

a water feed tube through which the cooling water supplied from an outside flows; and a water feed nozzle to which the water feed tube is connected, and for supplying the cooling water to the inside of the condensation duct.

59. The washing machine and dryer of claim 58, wherein the water feed tube is rotatably connected to the water feed nozzle with maintaining a sealing state with respect to the water feed nozzle.

60. The washing machine and dryer of claim 58, wherein the water feed tube is connected to the water feed nozzle so as to have a predetermined back and forth separation with maintaining a sealing state with respect to the water feed nozzle.

61. The washing machine and dryer of claim 1, wherein the siphon hose supplies the cooling water flowing inversely through the drain hose to the cooling water supply unit.

62. The washing machine and dryer of claim 61, wherein the cooling water supply unit comprises:

a water feed tube through which the cooling water supplied from an outside flows; and a water feed nozzle to which the water feed tube and a siphon hose are connected, and for supplying the cooling water to the inside of the condensation duct.

63. The washing machine and dryer of claim 62, wherein the water feed nozzle comprises:

a cylindrical nozzle body of which one end is opened;

a first connection hole formed at one side of the nozzle body and to which the water feed tube is connected; and a second connection hole formed at the other side of the nozzle body and to which the siphon hose is connected.

64. The washing machine and dryer of claim 63, wherein the nozzle body further comprises an air hole for maintaining the inside and the outside of the condensation duct at the same pressure.

65. The washing machine and dryer of claim 64, wherein the air hole is formed at the closed other end of the nozzle body.

* * * * *